US011253913B2

(12) United States Patent
Riemann et al.

(10) Patent No.: US 11,253,913 B2
(45) Date of Patent: Feb. 22, 2022

(54) PROCESS FOR PRODUCING A METALLIC CASTING OR A CURED SHAPED PART USING ALIPHATIC POLYMERS COMPRISING HYDROXY GROUPS

(71) Applicant: HÜTTENES-ALBERTUS Chemische Werke Gesellschaft mit beschränkter Haftung, Düsseldorf (DE)

(72) Inventors: Klaus Riemann, Wunstorf (DE); Nicola Mancini, Ostra Vetere (IT); Gérard Ladégourdie, Düsseldorf (DE); Hermann Lieber, Langenhagen (DE); Nils Zimmer, Garbsen (DE); Jürgen Hübert, Langenhagen (DE)

(73) Assignee: HÜTTENES-ALBERTUS CHEMISCHE WERKE GESELLSCHAFT MIT BESCHRÄNKTER HAFTUNG, Düsseldorf (DE)

( * ) Notice: Subject to any disclaimer, the term of this patent is extended or adjusted under 35 U.S.C. 154(b) by 0 days.

(21) Appl. No.: 16/956,727

(22) PCT Filed: Dec. 18, 2018

(86) PCT No.: PCT/EP2018/085425
§ 371 (c)(1),
(2) Date: Jun. 22, 2020

(87) PCT Pub. No.: WO2019/121637
PCT Pub. Date: Jun. 27, 2019

(65) Prior Publication Data

US 2021/0121942 A1 Apr. 29, 2021

(30) Foreign Application Priority Data

Dec. 22, 2017 (DE) ..... 10 2017 131 255.2

(51) Int. Cl.
*B22C 9/12* (2006.01)
*B22C 1/20* (2006.01)
*B22C 1/22* (2006.01)

(52) U.S. Cl.
CPC ..... *B22C 1/2266* (2013.01); *B22C 9/12* (2013.01)

(58) Field of Classification Search
CPC ..... B22C 1/20; B22C 1/2266; B22C 9/12
See application file for complete search history.

(56) References Cited

U.S. PATENT DOCUMENTS

| | | | | |
|---|---|---|---|---|
| 3,926,716 | A | 12/1975 | Bates | |
| 3,960,798 | A * | 6/1976 | Nakazawa | B22C 1/20 524/387 |
| 4,080,213 | A | 3/1978 | Mori et al. | |
| 4,487,868 | A | 11/1984 | Armbruster et al. | |
| 5,810,918 | A * | 9/1998 | Landis | B22C 1/00 106/38.22 |
| 2007/0066707 | A1* | 3/2007 | Zenpo | B22C 15/08 523/139 |
| 2015/0174644 | A1* | 6/2015 | Deters | B22C 9/02 164/37 |

FOREIGN PATENT DOCUMENTS

| | | |
|---|---|---|
| DE | 102007026166 | 12/2008 |
| EP | 0415183 | 3/1991 |
| EP | 0608926 | 3/1994 |
| EP | 0743113 | 5/1996 |
| EP | 1721689 | 11/2006 |
| EP | 1769860 | 4/2007 |
| WO | 2008/110378 | 9/2008 |
| WO | 2008/113765 | 9/2008 |
| WO | 2013/014118 | 1/2013 |
| WO | 2017/084851 | 5/2017 |
| WO | 2017/093371 | 6/2017 |
| WO | 2017174826 | 10/2017 |

OTHER PUBLICATIONS

Apata et al. "The Use of Rice Husk Ash as an Aggregate for Foundry Sand Mould Production". In: Zhang L. et al. (eds) Energy Technology 2017. The Minerals, Metals & Materials Series. Springer, Cham. https://doi.org/10.1007/978-3-319-52192-3_44 (Year: 2017).*
Draft International Standard, Plastics-Poly(vinyl alcohol) (PVAL) materials—Part 2: Determination of properties, DIN EN ISO 15023-2:2017-02, 2016, English Translation, 43 pages.

* cited by examiner

*Primary Examiner* — Kevin E Yoon
(74) *Attorney, Agent, or Firm* — Duane Morris LLP; Gregory M. Lefkowitz; Brandon A. Chan

(57) ABSTRACT

A process (i) for producing a metal casting or (ii) for producing a cured shaped part for use in the casting of metallic castings is described. Furthermore, the use of an aliphatic polymer which comprises structural units containing hydroxy groups and has been crosslinked by etherification as binder of a shaped part for use in the casting of metallic castings is described. A shaped part for use in the casting of metallic castings, comprising at least one base mould material and a cured binder comprising or consisting of an aliphatic polymer which comprises structural units containing hydroxy groups and has been crosslinked by etherification, is likewise described. In addition, a cured shaped part which is producible by a process according to the invention and also a mould material mixture for use in the process of the invention are described.

15 Claims, 6 Drawing Sheets

Figure 1:
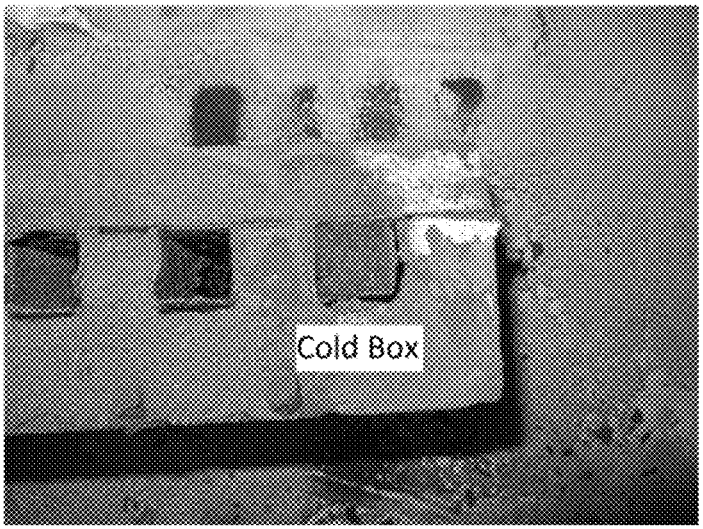

PROCESS FOR PRODUCING A METALLIC CASTING OR A CURED SHAPED PART USING ALIPHATIC POLYMERS COMPRISING HYDROXY GROUPS

CROSS-REFERENCE TO RELATED APPLICATIONS

This application is a § 371 national stage entry of International Application No. PCT/EP2018/085425, filed on Dec. 18, 2018, which claims priority to German Patent Application No. 102017131255.2, filed on Dec. 22, 2017, the entire contents of which are incorporated herein by reference.

The present invention relates to a process (i) for producing a metallic casting or (ii) for producing a cured shaped part for use in the casting of metallic castings. The present invention further relates to the use of an aliphatic polymer which comprises structural units containing hydroxy groups and has been crosslinked by etherification as binder for a shaped part for use in the casting of metallic castings. The present invention likewise relates to a shaped part for use in the casting of metallic castings, which comprises at least one base mould material and a cured binder comprising or consisting of an aliphatic polymer which comprises structural units containing hydroxy groups and has been crosslinked by etherification. In addition, the present invention relates to a cured shaped part which can be produced by a process according to the invention and also a mould material mixture for use in the process of the invention.

Foundry shaped parts used in metal casting (hereinafter referred to as "shaped parts" for short), in particular cores, moulds and feeders (including feeder caps and feeder casings or feeder sheaths), normally consist of a refractory base mould material which comprises, depending on the intended use, one or more refractory solids, for example silica sand, and/or one or more particulate lightweight fillers, for example spheres composed of fly ash, and a suitable binder which gives the shaped part sufficient mechanical strength after being taken from the moulding tool (for instance a shaped part box such as a core box or a mould box, see below). In the uncured state, the mixture of base mould material and binder, which can optionally contain further additives, is referred to as "mould material mixture".

Refractory solids are preferably present in particulate and free-flowing form, so that they can, after being incorporated into a mould material mixture, be introduced into a suitable hollow mould (the moulding tool, see above) and be densified there. Feeders and cores are for this purpose usually introduced, i.e. "shot", under pressure into a mould in core shooting machines. Relatively small shaped parts are often likewise shot, while larger shaped parts, in particular relatively large moulds, are usually shaped by stamping in a mould box. In general, all shaped parts can also be produced by stamping in appropriate moulds, for example in manual forming processes. In order to obtain shootable or stampable mould material mixtures, the moisture content thereof, in the case of water-based binders in particular the water content thereof, has to be set appropriately so that the mould material mixture has sufficient dimensional stability for the respective moulding procedure, or the ratio of the liquid constituents of the mould material mixture to the solid constituents thereof has to be set appropriately.

Shaped parts such as moulds, cores and feeders have to meet various requirements typical of foundries. The way in which and the extent to which these requirements are satisfied are determined essentially by the binder used for the production thereof:

After production of a shaped part, i.e. immediately after the shaped part has been taken from the production tool, it should have a very high strength. The strengths at this point in time ("initial strength") are particularly important for safe handling of cores, moulds or feeders when they are taken from the moulding tool.

A high final strength (i.e. the strength after complete curing of the shaped part) and a high heat resistance of the shaped parts during the actual casting of metal are also important, in particular for cores and moulds, in order for the shaped part not to deform under the weight of the casting metal (i.e. to retain good dimensional stability during the casting operation, also referred to as "casting strength") and for the metal casting produced therewith to be able to be produced preferably without casting defects. In this context, it is also important that the shaped parts used have a very clean or smooth surface without distortions or the like since otherwise surface defects of the shaped parts can be transferred to the surfaces of the metal castings produced by means of these.

Furthermore, high resistance of the shaped parts to aqueous moisture is a great advantage. In general, such a high moisture resistance allows a relatively long storage life of the shaped parts, even under demanding climatic conditions (hot, humid climate) and in the ideal case for a number of days or weeks, which assists production of shaped parts for stock and also the storage thereof or makes it possible for the first time. In this way, the industrial manufacture of metal castings using these shaped parts gains considerably in terms of flexibility. It has also been found that in the case of all shaped parts used for the casting of metal, in particular in the case of feeders, water absorption (for instance during storage by uptake of moisture from the air) can lead to steam bubbles being formed from corresponding water inclusions at the high temperatures in the casting of metal, which can lead to sink hole formation in the metal casting, making this unusable. In an extreme case, it is even possible for explosions to occur due to sudden water vapour formation. A high moisture resistance of the shaped parts is likewise advantageous since it allows, for example, the use thereof with different types of washes and in particular also with water-based washes. Washes are ceramic-based release agents which in certain cases are intended to prevent direct contact between shaped parts, for example cores, and the metal melt so that the shaped parts can better withstand the high thermal stresses during casting of the metal.

With a view to a high metal casting quality, it is also desirable for shaped parts to withdraw very little heat energy from the metal melt, for instance by reactions of the binder as can occur, for example, in known melt reactions of water glass binders. Such withdrawal of heat energy can lead to premature solidification of the metal melt and thus to an unsatisfactory casting operation. This characterization of a binder in terms of its ability to take up heat energy itself is also referred to as its "quenching behaviour". In the case of feeders in particular, particularly good thermal insulation is desirable or necessary in order to keep the metal melt liquid for as long as possible during casting of the metal and achieve very low sink hole formation in the metal casting with any sink hole formation being permitted to occur at most very far outside the finished metal casting (for instance only in the feeder).

After the casting operation is complete, a shaped part should then preferably decompose under the action of the heat given off from the cast metal in such a way that it loses its mechanical strength, i.e. the cohesion between the individual particles of the base mould material is lost. In the ideal case, the shaped part then disintegrates again to give fine particles of the base mould material which can be removed effortlessly and with very little residue from the metal casting. If the shaped part is a core, such advantageous disintegration properties lead to particularly good core removal capability of a metal casting.

In this context, it is also particularly desirable for the decomposition of the shaped part, which is generally associated with thermal decomposition of the binder, to proceed in a preferably emission-free manner, i.e. without emission of unpleasant odours and/or materials which are hazardous to health in order to keep exposure or hazards to the health of the personnel working in the foundry as small as possible or to reduce or in the ideal case prevent such hazards. Such impairment by unpleasant odours and/or materials which are hazardous to health can occur, in particular, during casting using the hot metal melt, in which case the feeders in particular, which usually project from the casting mould, form the main cause, but also still after solidification of the metal casting when this is freed from the casting mould ("unpacked" or "demoulded").

Various organic and inorganic binders, which all suffer from the typical restrictions or disadvantages, are known for producing shaped parts for the foundry industry.

Among organic binders and binder systems, binders/binder systems whose curing can be effected in each case by cold or hot methods are known.

In the case of hot-curing processes, the mould material mixture is, after shaping, for example by means of the heated moulding tool, heated to a temperature which is sufficiently high to drive off the solvent present in the binder and/or initiate a chemical reaction by means of which the binder is cured. An example of such a hot-curing process is the "hot box process". It is nowadays employed mainly in the mass production of cores.

The term cold-curing processes is used to refer to processes which are carried out essentially without heating of the moulding tool used for core production, generally at room temperature or at a temperature resulting from any, for example chemical, reaction. Curing is effected, for example, by means of a gas which is introduced into the mould material mixture to be cured and triggers an appropriate chemical reaction. An example of such a cold-curing process is the "cold box process", which is nowadays widely used in the foundry industry.

However, both hot box processes and cold box processes use organic binders based on phenolic resin. These have, regardless of their composition, the disadvantage that when they are decomposed as desired by the temperatures prevailing during casting of the metal they sometimes liberate considerable amounts of pollutants such as benzene, toluene and xylene (also referred to as "BTX" for short). In addition, the casting of metal using such organic binders generally leads to undesirable emissions of odours and fumes or smoke. Undesirable emissions occur even during production and/or storage of the shaped parts in the case of some such binder systems.

As an alternative to the abovementioned organic binders, corresponding inorganic binders which do not display the abovementioned phenomenon of liberation of undesirable odours or pollutants during casting of the metal, or display this phenomenon only to a much smaller extent are known. An example of such an inorganic binder is water glass. The corresponding mould material mixture consists essentially of base mould material, for example silica sand, and water glass (as an aqueous solution of alkali metal silicates). The shaped mould material mixtures are cured by, for example, exposure to $CO_2$ gas.

However, the use of such inorganic binders is associated with other, typical disadvantages: thus, shaped parts produced from inorganic binders often have only low strengths. This is particularly clearly apparent immediately after the shaped part has been taken from the tool. In addition, the frequently low moisture resistance of these binders leads to restricted storage capability of the shaped parts produced therewith. Furthermore, inorganic binders often do not display satisfactory disintegration properties, as a result of which complicated after-working of the metal castings produced using such shaped parts becomes necessary. It is also known that water glass-bound feeders generally have less good insulating properties than feeders bound with organic binders. Finally, inorganic binder systems such as water glass are known to themselves take up, i.e. consume, appreciable quantities of heat energy during casting of metal, as a result of which the metal melt solidifies comparatively early so that casting defects can occur. This applies particularly in the casting of iron and steel.

In the prior art, a number of binders, including organic binders, and processes for producing shaped parts using such binders have been discussed:

The document DE-OS 26 15 714 relates to moulding sand compositions for casting of metal.

The document DE 39 28 858 A1 describes crosslinked hydrogels and processes for the production thereof.

The document U.S. Pat. No. 4,487,868 relates to foundry core compositions.

The document EP 0 743 113 A1 teaches a process for producing inorganic moulds.

The document DE 10 2007 026 166 A1 relates to a process for the thermoplastic shaping of polyvinyl alcohol and shaped bodies or granular materials produced therewith.

The document EP 1 721 689 A1 describes a process for producing a casting.

The document EP 1 769 860 A1 describes a moulding process and moulds produced by the process.

The document WO 2008/110378 A1 teaches a composition for producing feeders.

The document WO 2017/084851 A1 describes a mould, a process for the production thereof and the use thereof.

The document EP 0 608 926 B1 (corresponding to DE 694 04 687 T2) describes a core for a casting process.

However, in the light of the prior art there is still a need for a process for producing metallic castings or for producing cured shaped parts for use in the casting of metallic castings, which achieves one, more than one and in the ideal case all of the following properties:

- a high initial strength of the shaped parts produced by the process;
- a high final strength of the shaped parts produced by the process; if a shaped part is produced in fully cured form by the process for producing it, the initial strength can correspond to the final strength;
- a high casting resistance or heat resistance of the shaped parts produced by the process;
- a clean and smooth surface of the shaped parts produced by the process;
- a very high moisture resistance or a very high water resistance of the shaped parts produced by the process, so that, inter alia, a very good or long storage capability of the shaped parts even under various climatic conditions results and/or these parts can be used with water-based washes;

a very low heat energy uptake and in the ideal case a good thermal insulation action of the shaped parts produced by the process during casting of metal;

a very low emission of odorous materials and/or pollutants and also of smoke or fumes, in particular under the conditions of casting of metal, from the shaped parts produced by the process, both during casting of light metals and alloys thereof and also in the casting of iron and steel.

Furthermore, there is a need for a binder for a shaped part in the casting of metallic castings which has or achieves one, more than one and in the ideal case all of the advantageous relevant properties indicated above. Finally, there is a need for a shaped part which displays one, more than one and in the ideal case all of the relevant properties mentioned in connection with the above-described process.

It was therefore a primary object of the present invention to provide a process for producing a metallic casting or for producing a cured shaped part for use in the casting of metallic castings, which brings about or has one, more than one and in the ideal case all of the abovementioned advantageous properties.

It was a further object of the present invention to indicate a binder for use for a shaped part in the casting of metallic castings which has or brings about one, more than one and in the ideal case all of the abovementioned advantageous relevant properties, and also a mould material mixture for use in the abovementioned process.

It was likewise an object of the present invention to provide a shaped part for use in the casting of metallic castings which has one, more than one and in the ideal case all of the relevant properties mentioned in connection with the above-described process.

It has now surprisingly been found that the primary object and also further objects and/or subobjects of the present invention are achieved by an inventive process (i) for producing a metallic casting or (ii) for producing a cured shaped part selected from the group consisting of casting mould, core and feeder for use in the casting of metallic castings, comprising the following steps:

provision or production of a preferably particulate base mould material, provisional production of (a) an aqueous mixture comprising one or more aliphatic polymers in each case comprising structural units containing hydroxy groups and having the formula (I)

$$—CH_2—CH(OH)— \quad (I),$$

provision or production of (b) an aqueous mixture comprising one or more acids and/or one or more heat-labile acid precursors as catalyst for etherification of the hydroxy groups of the aliphatic polymer or polymers, combining of the base mould material with (a) the aqueous mixture comprising one or more aliphatic polymers and (b) with the aqueous mixture comprising one or more acids and/or one or more heat-labile acid precursors to give a preferably aromatics-free and/or phenolic resin-free mould material mixture, shaping of the mould material mixture and to effect curing of the shaped mould material mixture to give the cured shaped part, heating of the shaped mould material mixture so that heat-labile acid precursors present in the mould material mixture decompose with liberation of acid (if heat-labile acid precursors are used in the process of the invention)

and/or hydroxy groups of the aliphatic polymer or polymers crosslink with one another in the presence of the acid or acids with (at least partial) etherification of the hydroxy groups, and removal of water from the heated shaped mould material mixture, preferably so that a cured shaped part selected from the group consisting of casting mould, core and feeder results.

The process of the invention makes it possible to produce shaped parts for the foundry industry, in particular moulds, cores and feeders, which have a number of advantageous properties indicated below. For the purposes of the present invention, the term "feeder" refers both to feeders and to feeder casings, feeder inserts and feeder caps.

Thus, the shaped parts produced by the process of the invention have a high final strength (after drying or curing) and also a high casting resistance and a high heat resistance during casting, even of iron or steel. The advantageous smooth and clean surface structure of the shaped parts produced by the process of the invention is also conspicuous. Furthermore, it was able to be shown that the shaped parts produced by the process of the invention have a very good moisture resistance and water resistance, as a result of which they are outstandingly suitable for prolonged storage for days or weeks even under difficult climatic conditions (hot humid climate). In addition, the shaped parts produced by the process of the invention display only a low heat energy uptake during casting of metal, which is reflected in a low degree of sink hole formation which also occurs only in regions of the cast metal which are comparatively far from the actual metal casting (for example in the feeder connection). This property makes the process of the invention particularly suitable for producing feeders, in particular insulating feeders. After casting of the metal has occurred, the shaped parts produced by the process of the invention are also characterized by an extraordinarily advantageous unpacking behaviour since they largely disintegrate under the action of the heat liberated during casting of the metal and thus considerably simplify further working of the correspondingly produced metal casting because only few or in the ideal case no after-working steps are necessary on the metal casting produced.

A particular advantage of the shaped parts produced by the process of the invention is their emission behaviour, especially during the casting of metal and in the unpacking of metal castings which have been produced with the aid of these shaped parts produced according to the invention: thus, no or virtually no fume or smoke formation, no or virtually no occurrence of unpleasant odours and/or no or virtually no emissions of materials which are potentially harmful to health, as regularly occur when conventional, in particular aromatics-containing (e.g. phenolic resin-containing), organic foundry binders are used, are observed both in casting of light metals and alloys thereof (for instance in casting of aluminium) and in the casting of iron or steel or in the unpacking of the metal castings produced in this way. This applies particularly to the feeders produced by the process of the invention. Insulating feeders produced by the process of the invention also display no or virtually no undesirable emissions at the comparatively low temperatures of light metal casting. Exothermic feeders produced by the process of the invention also display no or virtually no undesirable emissions (for example evolution of fumes) during or after burning.

The invention and also preferred combinations according to the invention of preferred parameters, properties and/or constituents of the present invention are defined in the accompanying claims. Preferred aspects of the present invention are also indicated and defined in the following description and in the examples.

In the above-described process of the invention, the step of combining of the base mould material with (a) the aqueous mixture comprising one or more aliphatic polymers and (b) with the aqueous mixture comprising one or more acids and/or one or more heat-labile acid precursors to give a mould material mixture can be carried out in any industrially possible way.

Thus, the base mould material can firstly be combined with (a) the aqueous mixture comprising one or more aliphatic polymers, preferably mixed therewith, and subsequently (after the abovementioned combining is complete) (b) the aqueous mixture comprising one or more acids and/or one or more heat-labile acid precursors can be combined with the initial charge formed by the said combining, preferably mixed therewith.

Likewise, in the reverse order, the base mould material can firstly be combined with (b) the aqueous mixture comprising one or more acids and/or one or more heat-labile acid precursors, preferably mixed therewith, and subsequently (after the abovementioned combining is complete) (a) the aqueous mixture comprising one or more aliphatic polymers can be combined with the initial charge formed by the said combining, preferably mixed therewith.

Furthermore, it is also possible according to the invention to combine, preferably mix, the base mould material alternately with portions of (a) the aqueous mixture comprising one or more aliphatic polymers and of (b) the aqueous mixture comprising one or more acids and/or one or more heat-labile acid precursors.

In many cases, preference is also given to a process according to the invention, preferably a process (ii) according to the invention, in which the aqueous mixture comprising one or more aliphatic polymers (a) and the aqueous mixture comprising one or more acids and/or one or more heat-labile acid precursors (b) is provided or produced by provision or production of an aqueous binder system comprising (a) the aqueous mixture comprising one or more aliphatic polymers and (b) the aqueous mixture comprising one or more acids and/or one or more heat-labile acid precursors, where, in order to produce the mould material mixture, the base mould material is combined with the aqueous binder system, preferably mixed therewith, to give a mould material mixture.

The abovementioned aqueous binder system to be used in the process of the invention preferably comprises one or more aliphatic polymers in each case comprising structural units which contain hydroxy groups and have the formula (I) in a total amount in the range from 10% by weight to 40% by weight, particularly preferably in the range from 15% by weight to 35% by weight and very particularly preferably in the range from 20% by weight to 30% by weight, based on the total mass (or the total weight, respectively) of the aqueous binder system.

The abovementioned aqueous binder system to be used in the process of the invention preferably comprises one or more acids and/or one or more heat-labile acid precursors in a total amount in the range from 0.2% by weight to 10% by weight, particularly preferably in the range from 0.3% by weight to 5% by weight and very particularly preferably in the range from 0.4% by weight to 2.5% by weight, based on the total mass (or the total weight, respectively) of the aqueous binder system.

The abovementioned aqueous binder system to be used in the process of the invention preferably comprises, in addition to the abovementioned constituents, one or more aliphatic polymers in each case comprising structural units which contain hydroxy groups and have the formula (I) and one or more acids and/or one or more heat-labile acid precursors and only water as further constituent, so that the constituents present therein: one or more aliphatic polymers in each case comprising structural units which contain hydroxy groups and have the formula (I), one or more acids and/or one or more heat-labile acid precursors and water in each case add up to 100% by weight in this preferred variant.

The combining in the form of mixing of the components base mould material, aqueous mixture comprising one or more aliphatic polymers (a), aqueous mixture comprising one or more acids and/or one or more heat-labile acid precursors (b) and/or binder system with one another (as indicated above) can be carried out in a manner known to those skilled in the art using a stirrer suitable for this purpose.

Which variant is chosen for the step of combining of the base mould material with (a) the aqueous mixture comprising one or more aliphatic polymers and (b) with the aqueous mixture comprising one or more acids and/or one or more heat-labile acid precursors (or with the aqueous binder system) to give a mould material mixture depends mainly on the circumstances of the individual case:

If, for example, an aqueous mixture comprising one or more aliphatic polymers (a) which has a high dynamic viscosity is to be used, such a highly viscous aqueous mixture (a) is preferably either firstly combined with the base mould material (and this mixture is then combined with the aqueous mixture comprising one or more acids and/or one or more heat-labile acid precursors (b)) or combined with a premix which has been obtained by combining the base mould material with (b) the aqueous mixture comprising one or more acids and/or one or more heat-labile acid precursors, as described above.

The production of a premix of the aqueous mixture comprising one or more aliphatic polymers (a) by combining with the aqueous mixture comprising one or more acids and/or one or more heat-labile acid precursors (b), for example to give a binder system as indicated above, is preferred especially when this premix or this binder system is processed further by the process of the invention soon after it has been produced: this is because storage of such a premix or such a binder system over prolonged periods of time can lead to a deterioration in quality when such a premix or such a binder system contains free acid or free acids.

The production of a premix of the aqueous mixture comprising one or more aliphatic polymers (a) by combining with the aqueous mixture comprising one or more heat-labile acid precursors (b) but not comprising one or more acids (b), for example to give a binder system as indicated above, is therefore also preferred when this mixture is not intended for further processing by the process of the invention soon after it has been produced, since storage of such a premix or such a binder system which does not contain any free acid or acids is readily possible even for prolonged periods of time without or without appreciable deterioration in quality of the premix or of the binder system. This is a particular advantage of the variant of the process of the invention which comprises the provision or production (b) of an aqueous mixture comprising one or more heat-labile acid precursors as catalyst for etherification of the hydroxy groups of the aliphatic polymer or polymers.

The aqueous mixture comprising one or more aliphatic polymers in each case comprising structural units which contain hydroxy groups and have the formula (I) which is to be used in the process of the invention preferably comprises the one or more aliphatic polymers in a total amount (concentration) in the range from 10% by weight to 40% by weight, particularly preferably in the range from 15% by weight to 35% by weight and very particularly preferably in the range from 20% by weight to 30% by weight, based on the total mass (or the total weight, respectively) of the aqueous mixture comprising one or more aliphatic polymers.

The aqueous mixture comprising one or more acids and/or one or more heat-labile acid precursors which is to be used in the process of the invention preferably comprises the one or more acids and/or the one or more heat-labile acid precursors in a total amount (concentration) in the range from 0.2% by weight to 10% by weight, particularly preferably in the range from 0.3% by weight to 5% by weight and very particularly preferably in the range from 0.4% by weight to 2.5% by weight, based on the total mass (or the total weight, respectively) of the aqueous mixture comprising one or more acids and/or one or more heat-labile acid precursors.

In the above-described process according to the invention, the substep of heating of the shaped mould material mixture during curing of the shaped mould material mixture to give the cured shaped part is carried out in such a way that heat-labile acid precursors present in the mould material mixture decompose under the action of heat to liberate acid, if such heat-labile acid precursors are used in the process of the invention. The acids liberated in this way then likewise act as corresponding (at least partially etherifying) crosslinking acids in the substep of heating of the shaped mould material mixture during curing of the shaped mould material mixture to give the cured shaped part.

As a result of the (at least partially etherifying) crosslinking of hydroxy groups of the aliphatic polymer or polymers by means of the catalytic effect of the acid or acids used (including the acids liberated by the action of heat from heat-labile acid precursors, if present) with simultaneous heating (under the conditions or preferred conditions of the process of the invention) and removal of water (under the conditions or preferred conditions of the process of the invention), the mould material mixture is particularly comprehensively cured to give the cured shaped part, so that the abovementioned advantageous properties of such a shaped part result, in particular its good moisture resistance or its good water resistance. It is assumed that the at least partial etherification of the hydroxy groups of the aliphatic polymer or polymers with one another contributes significantly to this comprehensive and preferably water-resistant curing of the shaped mould material mixture to give the cured shaped part by the process of the invention. See below for preferred temperatures, acids and heat-labile acid precursors.

Preference is also given to a process according to the invention as indicated above, preferably a process (ii) according to the invention (or a preferred process according to the invention as described in this text), wherein the total moisture content, preferably the total water content, of the mould material mixture is set before or during shaping of the mould material mixture so that a mould material mixture which is able to be shot to give a shaped part, preferably a feeder or a core, and/or is able to be stamped to give a shaped part, preferably a mould, results;

and/or the step of curing of the shaped mould material mixture by heating of the shaped mould material mixture and removal of water from the heated shaped mould material mixture is carried out at least until a water-resistant cured shaped part, preferably a cured shaped part which is water-resistant all through, results, preferably at a temperature in the range from 100 to 300° C., preferably in the range from 150 to 250° C., particularly preferably in the range from 180 to 230° C.;

and/or the shaping of the mould material mixture is carried out by shooting, preferably in a shooting machine, or by introduction into a moulding box, and/or the mould material mixture comprises a sand, preferably a sand selected from the group of sands consisting of silica sand, zircon sand, olivine sand, chromite sand, mullite sand and mixtures thereof, and has a proportion of solids of more than 95% by weight, based on the total mass of the mould material mixture, and/or foam formation or bubble formation in the mould material mixture is minimised or avoided when carrying out the process, preferably in one or both steps selected from combining of the base mould material with (a) the aqueous mixture comprising one or more aliphatic polymers and (b) with the aqueous mixture comprising one or more acids and/or one or more heat-labile acid precursors to give a preferably aromatics-free and/or phenolic resin-free mould material mixture and shaping of the mould material mixture.

For the purpose of the present invention, the term "moulding tool" refers to any tool which is used in the foundry industry for shaping shaped parts, preferably selected from the group consisting of casting mould, core and feeder (including feeder caps and feeder sheaths), in particular moulding boxes and shooting machines for shooting shaped parts, in particular cores and feeders, including core shooting machines.

For the purposes of the present invention, the term "moulding box" encompasses any tool which is suitable for shaping a foundry shaped part selected from the group consisting of casting mould, core and feeder (including feeder caps and feeder sheaths), in particular mould boxes and core boxes.

The total moisture content of the mould material mixture is, in the context of the present invention, the total content in the mould material mixture of liquid (i.e. in liquid form minus any solids dissolved therein) constituents added to the base mould material or combined with the base mould material, reported in percent by weight based on the total mass (or the total weight, respectively) of the mould material mixture. The total moisture content of the mould material mixture includes the total water content and also the content of further constituents added in liquid form, if present, for instance of acid or acids added in liquid form.

Accordingly, the total water content of the mould material mixture is, for the purposes of the present invention, the total content in the mould material mixture of water (minus any solids dissolved therein) which has been added to the base mould material or combined with the base mould material, reported in percent by weight based on the total mass (or the total weight, respectively) of the mould material mixture.

The total moisture content, preferably the total water content, of the mould material mixture can be set before or during shaping of the mould material mixture, for example by an appropriately larger or smaller volume of one or more of the aqueous constituents of the mould material mixture (i.e. (a) the aqueous mixture comprising one or more aliphatic polymers, (b) the aqueous mixture comprising one or more acids and/or one or more heat-labile acid precursors and, if present, the aqueous binder system) being combined with the base mould material, with the concentrations of the said aqueous constituents of the mould material mixture being in each case able to be appropriately altered or adapted by a person skilled in the art, so that in each case the total amounts of one or more of the aliphatic polymers or of one or more acids and/or one or more heat-labile acid precursors which are necessary or desired for forming the mould material mixture are used. This is also possible during combining of the base mould material with the aqueous mixtures (for instance when the said aqueous constituents are combined a little at a time with the base mould material). A total moisture content or total water content of the mould material mixture which is too low can be brought to a suitable value by addition of suitable amounts of water.

A person skilled in the art can, using knowledge of the art, easily set the concentrations of the abovementioned aqueous mixtures (or of the aqueous binder system) and also set the total moisture content, preferably the total water content, of the mould material mixture before or during shaping of the mould material mixture (for instance by varying amount and type of the base mould material to be used in relation to the aqueous constituents used in the mould material mixture), so that a mould material mixture which is able to be shot to give a shaped part, preferably a feeder or a core, and/or is able to be stamped to give a shaped part, preferably a mould, results.

The total moisture content, preferably the total water content, of the mould material mixture must not be so high that a mould material mixture which is no longer sufficiently dimensionally stable, too soft or even fluid for shooting (in particular in a shaped part shooting machine) or for stamping results. The total moisture content, preferably the total water content, of the mould material mixture must, however, not be so low that the particles of the particulate base mould material do not result in a mould material mixture which is sufficiently dimensionally stable and cohesive for shooting (in particular in a core shooting machine) or for stamping.

The working examples reported in the present text indicate to a person skilled in the art how a total moisture content, preferably total water content, suitable for the process of the invention for producing the mould material mixture to be used in the process of the invention has to be selected. As a result of the setting of the total moisture content, preferably the total water content, of the mould material mixture in the manner indicated above, the process of the invention can advantageously serve for producing various shaped parts (moulds, cores and feeders) and be carried out using the tools customary in the foundry industry. The process of the invention can thus be integrated into the customary procedures which are already in operation, so that no or no appreciable changes in the equipment or procedure in the foundries are necessary.

The expression "dimensionally stable mould material mixture" preferably means, for the purposes of the present invention, that such a dimensionally stable mould material mixture retains its shape taken on as a result of shaping for at least 30 minutes (at 20° C. and atmospheric pressure) after shaping of the mould material mixture (in particular in a moulding tool selected from among mould boxes, core boxes and corresponding tools as constituents of a shooting machine) and removal of the moulding tool, without, for example, flowing apart or disintegrating.

Preference is therefore also given to a process (ii) according to the invention as indicated above (or a process according to the invention described as preferred in this text), comprising the step:

combining of the base mould material with (a) the aqueous mixture comprising one or more aliphatic polymers and (b) with the aqueous mixture comprising one or more acids and/or one or more heat-labile acid precursors to give a dimensionally stable mould material mixture.

The step of curing of the shaped mould material mixture by heating of the shaped mould material mixture and removal of water from the heated shaped mould material mixture as indicated above is preferably carried out until a water-resistant cured shaped part (preferably a cured shaped part which is water-resistant all through) results, preferably at a temperature as indicated in this text in the range from 100 to 300° C. or at a preferred temperature in the range from 150 to 250° C., particularly preferably in the range from 180 to 230° C. The time to be selected in each case for carrying out the process until a water-resistant cured shaped part (or a cured shaped part which is water-resistant all through) is obtained depends mainly on the dimensions of the shaped part to be produced, in particular the wall thicknesses or volumes thereof. Thus, for example, relatively small shaped parts such as feeders or feeder caps can be cured to a water-resistant state (or a state which is water-resistant all through) after only about 60 s -90 s under the conditions of the process of the invention, while larger shaped parts such as large cores or moulds have been cured to a water-resistant state (or a state which is water-resistant all through) only after longer periods of time of, for example, a number of minutes, for example after 30 minutes, under the conditions of the process of the invention. A person skilled in the art can, with the aid of general technical knowledge and the additional information in the present text, very easily select the precise process conditions, in particular process times, suitable for the purposes of a particular shaped part. If necessary, appropriate simple preliminary tests can be carried out to determine the suitable parameters.

The expression "shaped part cured to a water-resistant state" in this context and for the purposes of the present invention preferably means a shaped part produced by the process of the invention which, after complete immersion (i.e. complete immersion for a total time of 30 minutes) in deionized water at 20° C. and atmospheric pressure for a time of 30 minutes (stopwatch), remains dimensionally stable and does not disintegrate (even after being taken from the water); here, disintegration is preferably disintegration without additional action of external force. Particular preference is given to water-resistant cured shaped parts on which a penetration depth of not more than 4 mm, preferably not more than 3 mm, is measured by means of a core hardness tester GM-578 (from Simpson Technologies GmbH, Switzerland) (according to the handling instructions for the core hardness tester) immediately after this immersion test (under the abovementioned conditions).

The expression "shaped part which has been cured to a water-resistant state all through" refers in this context and for the purposes of the present invention to, in particular, a shaped part produced by the process of the invention in the case of which all internal volume regions (i.e. volume regions which do not adjoin the exterior surface of the shaped part) have been cured to a water-resistant state (as defined above). Such internal volume regions are accessible for the purposes of the test by, for example, sawing.

The process of the invention is, according to the preferred embodiment indicated above, carried out at least until a water-resistant cured shaped part, preferably a cured shaped part which is water-resistant all through, results. As soon as a water-resistant cured shaped part, preferably a cured shaped part which is water-resistant all through, results under the elected conditions of the inventive process, the curing by heating of the shaped mould material mixture and removal of water from the heated shaped mould material mixture is preferably discontinued. This is because it has been found in our experiments that excessively prolonged continuation of the heating of the shaped mould material mixture and the removal of water from the heated shaped mould material mixture after a water-resistant cured shaped part, preferably a cured shaped part which is water-resistant all through, has been obtained leads to an impairment of the properties of such shaped parts which have been heated for an excessively long time, possibly as a result of incipient decomposition of the binder used (i.e. aliphatic polymer which formerly contained hydroxy groups and has been crosslinked by acid). To set suitable process parameters such as, in particular, the duration of the step of curing (in particular heating) of the shaped mould material mixture for the production of particular shaped parts by the process of the invention, such suitable parameters can, for example, be determined in preliminary tests and subsequently used for mass production of the shaped parts. The process procedure indicated above ensures that the shaped parts produced according to the invention acquire or retain their advantageous properties, in particular their good moisture resistance or their good water resistance.

In an above-described preferred embodiment of the process of the invention, the shaping of the mould material mixture is carried out by shooting, preferably in a shooting machine such as a core shooting machine, or by introduction of the mould material mixture into a moulding box and preferably stamping of the mould material mixture in the moulding box.

According to the invention, a shooting machine having a heatable moulding box, for instance a core shooting machine having a heatable core box, as is known per se for use in the processing of hot box binders or thermally curing water glass binders is, for example, suitable for shooting the mould material mixture. Such a shooting machine preferably also has a facility for passing a gas, preferably warm or hot air, through the shaped mould material mixture.

The mould material mixture which has been shot in by means of such a shooting machine can then be cured in the heatable mould box (for instance core box) with heating (by heating and/or passage of warm or hot air) and removal of water (for example by means of passage of warm or hot air) to give the (preferably water-resistant) cured shaped part. If no shooting machine with heatable mould box is used, a shot mould material mixture can also be cured in another way, for example (together with the moulding tool) in a drying oven, to give the (preferably water-resistant) cured shaped part. The suitable method of carrying out shaping in each case can be selected by a person skilled in the art according to the circumstances of the individual case. Thus, the mould material mixture for producing relatively small shaped parts, for instance feeders or feeder caps or relatively small cores or moulds, is advantageously shot in a shooting machine, particularly preferably in a core shooting machine. Larger shaped parts, for example larger cores or larger moulds, are advantageously shaped by introduction of the appropriate mould material mixtures into a mould box (e.g. core box) and preferably compacted by stamping. In the production of such relatively large shaped parts, the shaped mould material mixture is preferably cured in the core box or mould box in which it is present to give the (preferably water-resistant) cured shaped part.

When carrying out the process of the invention, foam formation or bubble formation in the mould material mixture is preferably avoided, preferably in the step of "combining of the base mould material with (a) the aqueous mixture comprising one or more aliphatic polymers and (b) with the aqueous mixture comprising one or more acids and/or one or more heat-labile acid precursors to give a preferably aromatics-free and/or phenolic resin-free mould material mixture" and/or in the step of "shaping of the mould material mixture", preferably by minimising or avoiding in one or both of said steps as much as possible the introduction of air or other gases into the mould material mixture. Some aliphatic polymers comprising structural units which contain hydroxy groups and have the formula (I) may tend to foam formation or bubble formation; such foam formation or bubble formation is, however, undesirable in the production of a cured shaped part for use in the casting of metallic castings according to the process of the present invention, for example because a foam-containing or bubble-containing mould material mixture has a porous structure in the curing to give the cured shaped part, as a result of which the desired strength and/or heat-resistance of the resulting shaped part can be impaired.

Furthermore, preference is also given to a process according to the invention as indicated above, preferably a process (ii) according to the invention (or a preferred process according to the invention described in this text), wherein the heating of the shaped mould material mixture is carried out to a temperature in the range from 100° C. to 300° C., preferably in the range from 150° C. to 250° C., particularly preferably in the range from 180° C. to 230° C., and/or wherein the removal of water from the heated shaped mould material mixture is carried out by means of one or more measures selected from the group consisting of passage of a heated gas, evacuation and drying in a drying apparatus, preferably by passage of a heated gas, particularly preferably by passage of heated air.

The drying apparatus indicated above is preferably selected from the group consisting of drying oven, convection drying oven, belt dryer, continuous dryer, tunnel dryer and dry belt. The drying apparatus is preferably a convection drying oven.

It has been found that the shaped parts produced by the process of the invention can be cured (preferably to a water-resistant state) particularly well and in a comparatively short period of time in the temperature range indicated above, so that advantageously short cycle times in the production of the shaped parts are possible but the shaped parts do not entirely or partially lose their advantageous properties (see above) again as a result of excessive heating.

It has also been found that the removal of water from the shaped mould material mixture in the process of the invention can be carried out particularly efficiently and advantageously in combination with the heating of the mould material mixture by passing a heated gas, preferably heated air, through the shaped mould material mixture. In this way, the shaped mould material mixture is cured particularly rapidly and completely, also in the interior thereof, to give the cured shaped part. It is assumed that the removal of water from the heated shaped mould material mixture promotes the at least partial etherification of hydroxy groups of the aliphatic polymer or polymers, for instance by means of the shifting of the reaction equilibrium to the desired side (LeChatelier's principle) known to the person skilled in the art. Sulfuric acid is therefore a preferred acid for use in the process of the invention.

In general, the setting of the precise process parameters for curing of the shaped mould material mixture to give the cured shaped part, for example the duration of heating, the temperature of the drying oven or of the heated gas, the time for which the heated gas is passed through (i.e. the duration of the passage of the heated gas) and the pressure of the heated gas (if used), is greatly dependent on the geometric dimensions of the shaped part to be produced by curing, for example its size, its weight, its volume and/or its wall thicknesses. For suitability of preliminary tests for determining suitable parameters for carrying out the process of the invention, see above.

Preference is likewise given to a process according to the invention as indicated above, preferably a process (ii) according to the invention (or a preferred process according to the invention as described in this text), wherein the aliphatic polymers used

- can be produced by at least partial hydrolysis of polyvinyl acetate,
- and/or
- are dissolved in the aqueous mixture in which they are present in an amount of preferably at least 90% by weight, particularly preferably at least 95% by weight, based on the total mass (or the total weight, respectively) of aliphatic polymers used.

In addition, preference is likewise given to a process according to the invention as indicated above, preferably a process (ii) according to the invention (or a preferred process according to the invention as described in this text), wherein the one or more aliphatic polymers comprising structural units which contain hydroxy groups and have the formula (I) comprise one or more polyvinyl alcohols, wherein the totality of the polyvinyl alcohols used preferably

- has a degree of hydrolysis of >50 mol % (i.e. in the range from 50.1 mol % to 100 mol %), preferably determined by the method as indicated in the document DE 10 2007 026 166 A1, paragraphs [0029] to [0034],
  - and particularly preferably has a degree of hydrolysis in the range from 70 mol % to 100 mol %, very particularly preferably in the range from 80 mol % to 100 mol %, preferably determined by the method according to DIN EN ISO 15023-02 2017-02 draft, appendix D,
- and/or
- has a dynamic viscosity in the range from 0.1 to 30 mPa·s, preferably in the range from 1.0 to 15 mPa·s, particularly preferably in the range from 2.0 to 10 mPa·s, in each case determined on a 4% strength (w/w) aqueous solution of the totality of the polyvinyl alcohols used at 20° C. in accordance with DIN 53015:2001-02.

It has been found that the one or more aliphatic polymers indicated above, in particular the one or more polyvinyl alcohols indicated above as being preferred, contribute significantly to the advantageous properties of the shaped parts produced according to the invention when they are processed by the process of the invention, especially to give the good moisture resistance or water resistance, final strength and casting resistance of the shaped parts produced according to the invention.

Furthermore, it is assumed that the one or more aliphatic polymers indicated above, in particular the one or more polyvinyl alcohols indicated above as being preferred, contribute significantly to or are even the cause of the advantageous emission properties of the shaped parts produced according to the invention (possibly because the aliphatic polymers to be used according to the invention do not contain any aromatic constituents like phenolic resins which are frequently mentioned as cause of harmful emissions), in particular the low r completely absent emission of fumes or smoke and/or of odorous materials and/or pollutants during or after the casting of metal and also the low or completely absent emission of odorous materials and/or pollutants in the production or storage of the shaped parts.

The one or more aliphatic polymers to be used according to the invention are therefore preferably free of aromatics-containing and/or phenolic resins-containing constituents and/or other constituents which cause smoke, fume, odour and/or pollutant emissions to an appreciable extent under the conditions of the process of the invention.

For the reasons indicated above, the process of the invention is preferably not carried out in the presence of aromatics-containing and/or phenolic resins-containing organic compounds or the mould material mixture produced in the process of the invention is aromatics-free and/or phenolic resins-free (i.e. the mould material mixture produced in the process of the invention preferably does not contain any aromatics-containing organic compounds like phenolic resins).

The process of the invention is preferably not carried out in the presence of furan-containing organic compounds or the mould material mixture produced in the process of the invention does not contain any furan-containing organic compounds.

The process of the invention is preferably not carried out in the presence of alkoxysilyl compounds or the mould material mixture produced in the process of the invention does not contain any alkoxysilyl compounds.

Preference is therefore also given to a process (ii) according to the invention as indicated above (or a preferred process according to the invention described in this text), wherein the mould material mixture consists of the following constituents (or the process is carried out so that a mould material mixture which consists of the following constituents is produced):

- a (preferably particulate) base mould material,
- one or more aliphatic polymers in each case comprising structural units which contain hydroxy groups and have the formula (I)
- one or more acids and/or one or more heat-labile acid precursors,
- and
- water.

Furthermore, preference is also given to a process according to the invention as indicated above, preferably a process (ii) according to the invention (or a preferred process according to the invention described in this text), wherein the base mould material comprises:

one or more particulate refractory solids selected from the group consisting of
- oxides, silicates and carbides, in each case comprising one or more elements from the group consisting of Mg, Al, Si, Ca, Ti, Fe and Zr;
- mixed oxides, mixed carbides and mixed nitrides, in each case comprising one or more elements from the group consisting of Mg, Al, Si, Ca, Ti, Fe and Zr;
- and
- graphite and/or one or more particulate lightweight fillers, preferably selected from the preferred group consisting of
- core-shell particles, preferably having a glass core and a refractory shell, particularly preferably having a bulk density in the range from 470 to 500 g/l, preferably as described in the document WO 2008/113765;
- spheres, preferably spheres composed of fly ash;
- composite particles, preferably as described in or as produced according to the document WO 2017/093371 A1;
- perlite, preferably expanded perlite, particularly preferably closed-pored microspheres composed of expanded perlite, preferably as described in the document WO 2017/174826 A1;
- rice hull ash, preferably as described in the document WO 2013/014118 A1;
- expanded glass,
- hollow glass spheres,
- and
- hollow ceramic spheres, preferably hollow α-alumina spheres.

The abovementioned one or more particulate refractory solids can be used individually or in combination with one another and thus form the base mould material to be used. Likewise, the abovementioned one or more particulate lightweight fillers can be used individually or in combination with one another and thus form the base mould material to be used. Naturally, it is also possible to use the one or more particulate refractory solids in combination with the one or more particulate lightweight fillers as base mould material, so as to form the base mould material to be used. Depending on the intended use of the process of the invention, i.e. depending on the shaped part to be produced, a person skilled in the art will select the base mould material which is suitable in each case. For example, only silica sand can be selected as base mould material in order to produce a simple casting mould. Furthermore, for example for the production of a feeder, a mixture of silica sand with one or more particulate lightweight fillers can be selected or else exclusively one or more particulate lightweight fillers can be selected for this purpose, preferably lightweight fillers selected from the above-defined, preferred group of lightweight fillers.

The base mould material to be used in the process of the invention can contain, in addition to the abovementioned preferred constituents, further, preferably particulate, constituents which are preferably selected from the group consisting of elemental metals (for example aluminium), oxidants or oxygen sources, preferably metal oxides, particularly preferably oxides of manganese and/or iron, and igniters. Thus, for example for production of an exothermic feeder, the base mould material to be used can contain aluminium, iron oxide, an oxidant known per se for this purpose, spheres and an igniter known per se for this purpose.

Furthermore, preference is also given to a process according to the invention as indicated above, preferably, a process (ii) according to the invention (or a preferred process according to the invention described in this text), wherein the ratio
- of the total mass of aliphatic polymers used
- to
- the total mass of base mould material used is in the range from 0.2:100 to 13:100, preferably in the range from 0.3:100 to 10:100, particularly preferably in the range from 0.5:100 to 9:100, and/or the ratio
- of the sum
  - of the total mass of the aqueous mixture comprising one or more aliphatic polymers (a) which is used
  - and
  - the total mass of the aqueous mixture comprising one or more acids and/or one or more heat-labile acid precursors (b) which is used
- to
- the total mass of base mould material used is in the range from 1:100 to 50:100, preferably in the range from 1.5:100 to 40:100, particularly preferably in the range from 2:100 to 35:100;

and/or the ratio
- of the total mass of acids and/or heat-labile acid precursors used
- to
- the total mass of aliphatic polymers used is in the range from 1:5 to 1:50, preferably in the range from 1:10 to 1:50, particularly preferably in the range from 1:20 to 1:40 and very particularly preferably in the range from 1:25 to 1:35.

The setting of the abovementioned (numerical) ratio of the sum of the total mass of the aqueous mixture comprising one or more aliphatic polymers (a) which is used and the total mass of the aqueous mixture comprising one or more acids and/or one or more heat-labile acid precursors (b) which is used to the total mass of base mould material used is, as indicated above, preferably carried out so that a preferably dimensionally stable mould material mixture which can be shot to give a shaped part, preferably a feeder or a core, and/or can be stamped to give a shaped part, preferably a mould, results. An aqueous mixture comprising one or more aliphatic polymers (a) or an aqueous mixture comprising one or more acids and/or one or more heat-labile acid precursors (b), which each have a preferred total amount as indicated above of one or more aliphatic polymers (a) or of one or more acids and/or one or more heat-labile acid precursors (b) is preferably used in each case. In this context, it has been found that the abovementioned ratio (at in each case unchanged concentrations of the aqueous mixtures used) also depends on the type of base mould material used: thus, the suitable numerical ratio indicated above is usually in the high part of the range (i.e. closer to the upper limit of 50:100, preferably 40:100 and particularly preferably 35:100) in cases in which a base mould material having a relatively low bulk density (for instance lower than silica sand) is used, while the abovementioned suitable numerical ratio tends to be in the lower part of the range (i.e. closer to the lower limit of 1:100, preferably 1.5:100 and particularly preferably 2:100) in cases in which a base mould material having a relatively high bulk density (for instance silica sand) is used.

The ratio of the total mass of acids used (or to be used) and/or heat-labile acid precursors to the total mass of aliphatic polymers used is, according to the invention, at comparatively low numerical values, i.e. it indicates a comparatively low total mass of acids and/or heat-labile acid precursors used or to be used relative to the total mass of aliphatic polymers used. Accordingly, a (significantly) substoichiometric amount of one or more acids and/or of one or more heat-labile acid precursors (relative to the amount of aliphatic polymers used) is preferably sufficient for carrying out the process of the invention since the acid or acids preferably act(s) as catalyst for etherification of the hydroxy groups of the aliphatic polymer or polymers with one another.

The one or more acids to be used according to the invention and/or the one or more heat-labile acid precursors are preferably free of aromatics-containing constituents like phenolic resins and/or other constituents which cause smoke, fume, odour and/or pollutant emissions to an appreciable extent under the conditions of the process of the invention.

Preference is likewise given to a process according to the invention as indicated above, preferably a process (ii) according to the invention (or a preferred process according to the invention described in this text), wherein the one or more acids and/or the one or more heat-labile acid precursors are selected from the group consisting of:

- inorganic, preferably water-soluble, protic acids which have a pKa of ≤7, preferably a pKa of ≤5, particularly preferably a pKa of ≤3,
- organic protic acids, preferably monoprotic organic protic acids which have a pKa of ≤7, preferably a pKa of ≤5, and are particularly preferably selected from the group consisting of methanesulfonic acid, formic acid, acetic acid, lactic acid and ascorbic acid,
- Lewis acids, preferably water-soluble Lewis acids, particularly preferably selected from the group consisting of boron trifluoride and the chlorides and bromides of boron, aluminium, phosphorus, antimony, arsenic, iron, zinc and tin,
- and
- salts which can be thermally decomposed to acids (i.e. heat-labile acid precursors), preferably selected from the group consisting of
  - ammonium salts of mineral acids, e.g. $NH_4NO_3$, preferably $NH_4Cl$,
  - sulfates and chlorides of trivalent metal ions, preferably $FeCl_3$, $AlCl_3$, $Fe_2(NO_3)_3$, $Al_2(NO_3)_3$, $Fe_2(SO_4)_3$ and $Al_2(SO_4)_3$
  - and
  - sulfuric acid salts of alkanolamines, preferably of monoethanolamine.

For the purposes of the present invention, "protic acids" are compounds which are classified as acids according to the acid-based concept of Brönsted and Lowry.

For the purposes of the present invention, the term "monoprotic organic acids" refers to organic acids which have precisely one group which in the presence of water can make available a proton ($H^+$ ion), for example a carboxyl group or a sulfonic acid group.

The abovementioned inorganic, preferably water-soluble, protic acids are preferably selected from the group consisting of phosphoric acid (including condensates thereof such as pyrophosphoric acid and metaphosphoric acids), esters of phosphoric acid, boric acid, esters of boric acid, sulfuric acid, hydrochloric acid, hydrobromic acid, hydroiodic acid and nitric acid and are particularly preferably selected from the group consisting of phosphoric acid, esters of phosphoric acid, sulfuric acid, hydrobromic acid and hydroiodic acid.

The one or more acids and/or the one or more heat-labile acid precursors are preferably selected from the group consisting of:

- inorganic, preferably water-soluble, protic acids which have a pKa of ≤7, preferably a pKa of ≤5, particularly preferably a pKa of ≤3,
- and
- organic protic acids, preferably monoprotic organic protic acids, which have a pKa of ≤7, preferably a pKa of ≤5, and are particularly preferably selected from the group consisting of methanesulfonic acid, formic acid, acetic acid, lactic acid and ascorbic acid.

The one or more acids and/or the one or more heat-labile acid precursors are particularly preferably selected from the group consisting of:

- inorganic, preferably water-soluble, protic acids which have a pKa of ≤5, preferably a pKa of ≤3,
- and
- monoprotic organic protic acids which have a pKa of ≤5 and are preferably selected from the group consisting of methanesulfonic acid, formic acid, acetic acid, lactic acid and ascorbic acid.

Preference is also given to a process according to the invention as indicated above, preferably a process (ii) according to the invention (or a preferred process according to the invention described in this text), wherein the one or more acids and/or the one or more heat-labile acid precursors, preferably the one acid or at least one of the plurality of acids, are selected:

- from the group consisting of inorganic, preferably water-soluble, protic acids which have a pKa of ≤3
- and/or
- from the group consisting of phosphoric acid (including condensates thereof, e.g. pyrophosphoric acids and metaphosphoric acids) and sulfuric acid.

The abovementioned monoprotic organic protic acids which have a pKa of ≤5 have the advantage that, owing to their relatively high acid strength and owing to the only one acid group in the molecule, they bring about or participate in competing reactions to at least partial catalytic etherification of the hydroxy groups of the one or more polymers with one another to only a small extent (if at all).

It has been found that the abovementioned inorganic and monoprotic organic acids which in each case have a pKa of ≤5 and preferably a pKa of ≤3 bring about particularly rapid and complete curing of the shaped mould material mixture to the cured shaped part in the process of the invention, so that the energy consumption required by the process is lower due to the reaction times which have been shortened in this way and shorter cycle times (and thus higher production numbers per unit time) are possible than, for example, when using weaker acids.

It has also been found that when using weaker acids (for instance having a pKa of >5) in the process of the invention the ratio of the total mass of acids used to the total mass of aliphatic polymers used also has to be made higher (for instance in the range from 1:5 to 1:10) than when using inorganic and monoprotic organic acids which in each case have a pKa of ≤5 and preferably a pKa of ≤3.

Sulfuric acid has been found to be a particularly preferred acid for use in the process of the invention, apparently because it has an acid strength which is particularly suitable for catalysing the etherification of the hydroxy groups of the aliphatic polymer or polymers with one another.

Preference is therefore also given to a process (ii) according to the invention as indicated above (or a preferred process according to the invention described in this text), wherein the ratio of the total mass of acids and/or heat-labile acid precursors used to the total mass of aliphatic polymers used is in the range from 1:10 to 1:50, particularly preferably in the range from 1:20 to 1:40 and very particularly preferably in the range from 1:25 to 1:35, and the one or more acids and/or one or more heat-labile acid precursors are selected from the group consisting of phosphoric acid and sulfuric acid.

Furthermore, preference is given to a process according to the invention as indicated above, preferably a process (i) according to the invention (or a preferred process according to the invention described in this text), having the following additional step:

contacting of the cured shaped part with a casting metal to produce a metallic casting, with the casting metal preferably solidifying in contact with the cured shaped part, preferably so that a metallic casting results.

In the above-described preferred process of the invention, the casting metal is at least partially and preferably completely liquid on contacting the cured shaped part. Any castable metal or any castable metal alloy, in particular light metals and alloys thereof, for example aluminium, magnesium, tin and zinc; and also iron and steel, is suitable as casting metal.

It has been found in our own studies that at most small amounts of soot or smoke or fumes are formed on contacting of the cured shaped part produced according to the invention with the casting metal, regardless of the nature of the casting metal, and virtually no (or ideally no) gaseous aromatics-containing emissions or other emissions which are potentially harmful to human health are formed, for instance by decomposition of the crosslinked binder of the cured shaped part under the action of the heat of the liquid casting metal. This also applies at comparatively low temperatures in the range from 600° C. to 900° C., so that the abovementioned preferred process variant (i) is very particularly suitable for the production of metallic castings where the casting metal is a light metal or a light metal alloy: it is known that at the comparatively low temperatures (compared to the temperatures in iron or steel casting) prevailing in light metal casting, conventional cold box binders frequently used at present are often only incompletely thermally decomposed so that in these cases in particular, both in the casting of metal and in the unpacking of the moulds, particularly strong smoke, fume or soot formation and intensive liberation of gaseous, aromatics-containing emissions occur; these are usually accompanied by unpleasant odours and are potentially hazardous to human health. Such disadvantages in contrast do only occur to a substantially lesser extent or ideally do not occur when using shaped parts produced by the process of the invention or when carrying out the abovementioned preferred process variant (i) according to the invention. Since there is a particularly strong danger of emissions from feeders or feeder caps during the casting of metal due to their position at the contact surface between casting moulds and the surrounding air, the abovementioned, preferred process variant (i) according to the invention is particularly effective when feeders or feeder caps are produced (process variant (ii)) or used (process variant (i)) as shaped parts when carrying out the process of the invention.

Preference is therefore also given in many cases to a process according to the invention as indicated above, preferably a process (i) according to the invention (or a preferred process according to the invention described in this text), wherein the casting metal is selected from the group consisting of aluminium, magnesium, tin, zinc and alloys thereof and/or the temperature of the casting metal during casting is not higher than 900° C. and the temperature of the casting metal during casting is preferably in the range from 600° C. to 900° C.

Furthermore, preference is also given to a process (ii) according to the invention as indicated above for producing a cured feeder for use in the casting of metallic castings (or in a preferred process according to the invention described in this text), wherein the base mould material comprises:

one or more particulate lightweight fillers, preferably selected from the group consisting of core-shell particles, preferably having a glass core and a refractory shell, particularly preferably having a bulk density in the range 470-500 g/l, preferably as described in the document WO 2008/113765;

spheres, preferably spheres composed of fly ash;

composite particles, preferably as described in or as produced according to the document WO 2017/093371 A1;

perlite, preferably expanded perlite, particularly preferably closed-pored microspheres composed of expanded perlite, preferably as described in the document WO 2017/174826;

rice hull ash, preferably as described in the document WO 2013/014118;

expanded glass, hollow glass spheres, and hollow ceramic spheres, preferably hollow α-alumina spheres;

and the base mould material further comprises or does not comprise:

one or more particulate refractory solids selected from the group consisting of oxides, silicates and carbides, in each case comprising one or more elements from the group consisting of Mg, Al, Si, Ca, Ti, Fe and Zr;

mixed oxides, mixed carbides and mixed nitrides, in each case comprising one or more elements from the group consisting of Mg, Al, Si, Ca, Ti, Fe and Zr;

and graphite.

The present invention also provides for the use of an aliphatic polymer which in each case comprises structural units which contain hydroxy groups and have the formula (I)

$$—CH_2—CH(OH)— \quad (I)$$

and has been crosslinked by etherification, preferably a corresponding (at least partially) crosslinked polyvinyl alcohol, as binder of a shaped part selected from the group consisting of casting mould, core and feeder in the casting of metallic castings.

As regards preferred embodiments of the use according to the invention and possible combinations of one or more associated aspects with one another, what has been said above with regard to the process of the invention applies analogously, and vice versa.

The present invention further provides a shaped part selected from the group consisting of casting mould, core and feeder for use in the casting of metallic castings, (the shaped part) comprising:

at least one (preferably particulate) base mould material and a cured binder comprising or consisting of an aliphatic polymer which in each case comprises structural units which contain hydroxy groups and have the formula (I)

$$—CH_2—CH(OH)— \quad (I)$$

and has been crosslinked by etherification, preferably comprising or consisting of a polyvinyl alcohol which has been (at least partially) crosslinked by etherification, where the ratio of the total mass of cured binder to the total mass of base mould material used is preferably in the range from 0.2:100 to 13:100, preferably in the range from 0.3:100 to 10:100, particularly preferably in the range from 0.5:100 to 9:100.

As regards preferred embodiments of the shaped part of the invention and possible combinations of one or more associated aspects with one another, what has been said above with regard to the process of the invention and to the use according to the invention applies analogously, and vice versa.

In the shaped part of the invention, the hydroxy groups of the crosslinking polymer are (at least predominantly) no longer present in free form as a result of the crosslinking with one another which has occurred by etherification but instead participate (at least predominantly) in the formation of ether groups.

The ranges indicated above for the ratio of total mass of cured binder to the total mass of base mould material used in the shaped part correspond to the indicated ranges for the ratio of the total mass of (uncrosslinked) aliphatic polymers used to the total mass of base mould material used. The corresponding mass ratio in the shaped part according to the invention will in individual cases differ from the corresponding mass ratio used in the process of the invention and may well lie at somewhat lower values in the shaped part according to the invention, especially because of the water of condensation which is liberated and removed during the etherifying crosslinking. However, this difference is in practice of no importance.

Preference is given to a shaped part according to the invention as indicated above, wherein the cured binder is a binder (as defined above) which has been cured so as to be water-resistant, particularly preferably a binder (as defined above) which has been cured so as to be water-resistant all through.

The present invention also provides a cured shaped part selected from the group consisting of casting mould, core and feeder produced or able to be produced by a process (ii) according to the invention as indicated above (or a preferred process according to the invention described in this text).

As regards preferred embodiments of the shaped part produced or able to be produced according to the invention and possible combinations of one or more associated aspects with one another, what has been said above with regard to the process of the invention, to the use according to the invention and to the shaped part of the invention applies analogously, and vice versa.

Furthermore, the present invention also provides a preferably aromatics-free and/or phenolic resin-free mould material mixture for producing a cured shaped part selected from the group consisting of casting mould, core and feeder for use in the casting of metallic castings, comprising (i.e. further constituents apart from the constituents mentioned below can be present) or consisting of (i.e. no further constituents apart from the constituents mentioned below can be present):

at least one (preferably particulate) base mould material, one or more aliphatic polymers in each case comprising structural units which contain hydroxy groups and have the formula (I)

$$—CH_2—CH(OH)— \quad (I)$$

one or more acids and/or one or more heat-labile acid precursors selected from the group consisting of:

inorganic, preferably water-soluble, protic acids which have a pKa of ≤7, preferably a pKa of ≤5, particularly preferably a pKa of ≤3, monoprotic organic protic acids which have a pKa of ≤7, preferably a pKa of ≤5, and are particularly preferably selected from the group consisting of methanesulfonic acid, formic acid, acetic acid, lactic acid and ascorbic acid, Lewis acids, preferably water-soluble Lewis acids, particularly preferably selected from the group consisting of boron trifluoride and the chlorides and bromides of boron, aluminium, phosphorus, antimony, arsenic, iron, zinc and tin, and salts which can be thermally decomposed to acids (heat-labile acid precursors), preferably selected from the group consisting of ammonium salts of mineral acids, for example $NH_4NO_3$, preferably $NH_4Cl$, sulfates and chlorides of trivalent metal ions, preferably $FeCl_3$, $AlCl_3$, $Fe_2(NO_3)_3$, $Al_2(NO_3)_3$, $Fe_2(SO_4)_3$ and $Al_2(SO_4)_3$, and sulfuric acid salts of alkanolamines, preferably of monoethanolamine, and water.

As regards preferred embodiments of the mould material mixture of the invention and possible combinations of one or more associated aspects with one another, what has been said above with regard to the process of the invention, to the use according to the invention, to the shaped part according to the invention and to the shaped part produced or able to be produced by the process of the invention applies analogously, and vice versa.

Preference is given to a mould material mixture according to the invention as indicated above for producing a cured feeder for use in the casting of metallic castings, wherein the base mould material comprises or consists of:

one or more particulate lightweight fillers, preferably selected from the group consisting of core-shell particles, preferably having a glass core and a refractory shell, particularly preferably having a bulk density in the range 470-500 g/l, preferably as described in the document WO 2008/113765;

spheres, preferably spheres composed of fly ash;

composite particles, preferably as described in or as produced according to the document WO 2017/093371 A1;

perlite, preferably expanded perlite, particularly preferably closed-pored microspheres composed of expanded perlite, preferably as described in the document WO 2017/174826;

rice hull ash, preferably as described in the document WO 2013/014118;

expanded glass, hollow glass spheres, and hollow ceramic spheres, preferably hollow α-alumina spheres;

and the base mould material further comprises or does not comprise:

one or more particulate refractory solids selected from the group consisting of oxides, silicates and carbides, in each case comprising one or more elements from the group consisting of Mg, Al, Si, Ca, Ti, Fe and Zr, mixed oxides, mixed carbides and mixed nitrides, in each case comprising one or more elements from the group consisting of Mg, Al, Si, Ca, Ti, Fe and Zr, and graphite.

The mould material mixture according to the invention as indicated above (or a preferred mould material mixture according to the invention indicated above) is suitable and intended for use in the process of the invention as described above.

FIGURES

FIG. 1 shows the left-over pieces of a comparative standard bending test bar "B cold box" in an iron casting after casting. It can be seen that the left-over pieces of the cold box-bound standard bending test bar remain virtually completely in the iron casting and were very difficult to remove (poor ability to remove the core, cf. Example 7).

Figure 2:
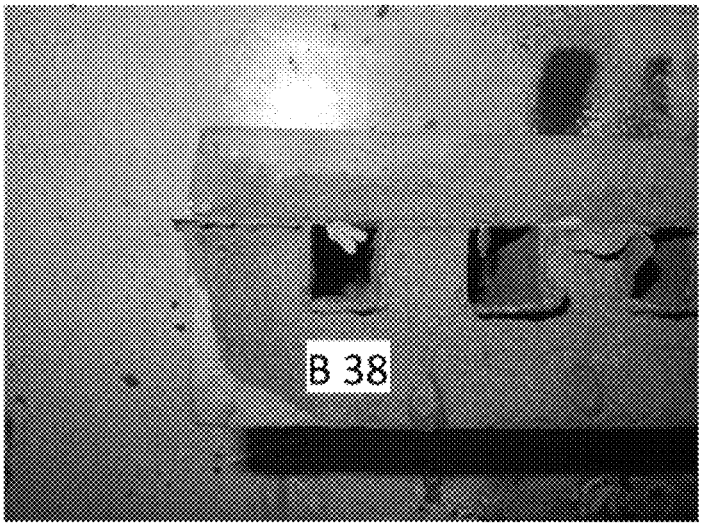

FIG. 2 shows the left-over pieces of a comparative standard bending test bar "B-V38" in an iron casting after casting. It can be seen that the left-over pieces of the standard bending test bar "B-V38" were able to be removed readily and virtually completely from the iron casting (good core removal capability, cf. Example 7).

Figure 3:
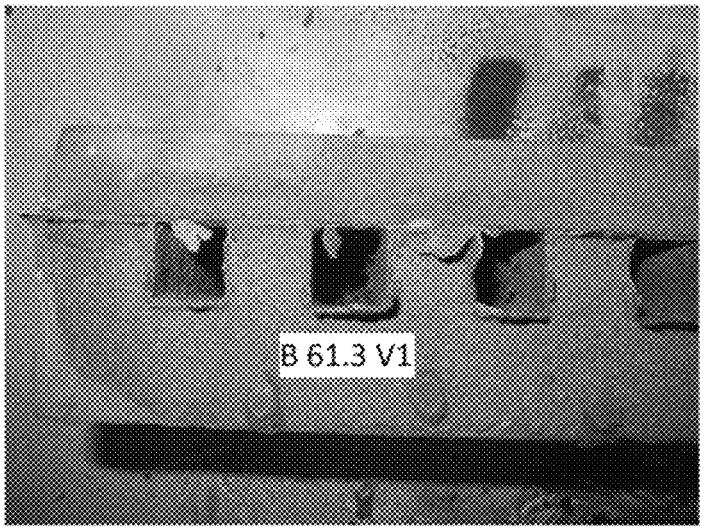

FIG. 3 shows the left-over pieces of a standard bending test bar "B-E61.3V1" produced by the process of the invention in an iron casting after casting. It can be seen that the left-over pieces of the standard bending test bar "B-E61.3V1" were able to be removed very readily and virtually completely from the iron casting (very good core removal capability, cf. Example 7).

The FIGS. 4 to 9 described below show cross sections of a cut-open iron casting which is sawn open in the middle (along the support surfaces of the standard bending test bar), so that the hollow spaces produced by standard bending test bars in the iron casting (after removal thereof from the iron casting) are divided into two halves in the middle of the length in the iron casting (for more details see Example 7). The cross sections of the hollow spaces produced by the standard bending test bars (casting negative) are as a result half in the upper half of the sawn-open metal casting (produced by the part of the standard bending test bar located at the top during the casting of iron, "upper mould half") and half in the lower half of the sawn-open metal casting (produced by the part of the standard bending test bar located at the bottom during the casting of iron, "lower mould half").

Figure 4:
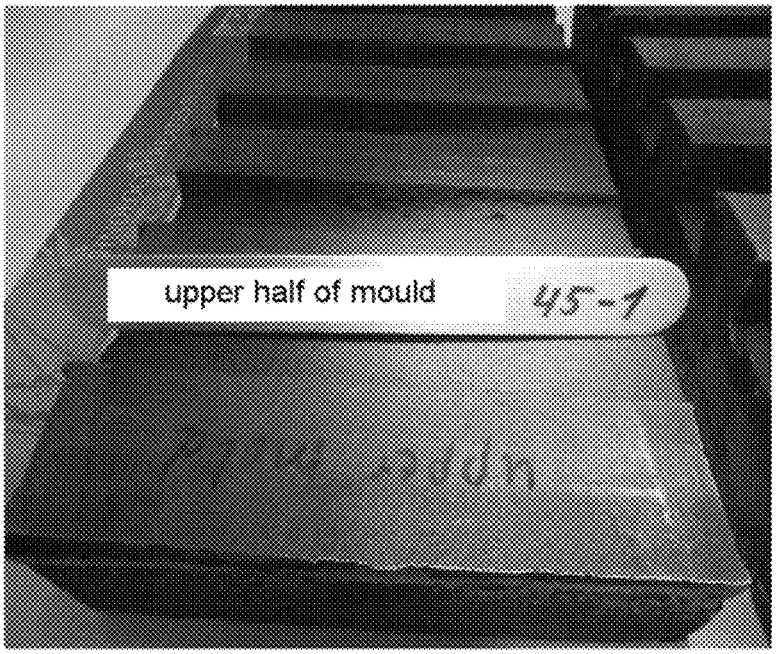

FIG. 4 shows, in cross section, the upper mould half of the iron casting. It is possible to see here the upper half of the hollow space (casting negative) formed by the standard bending test bar B-V38 (comparison) after removal thereof from the metal casting. It is possible to see with the aid of the straight wooden spatula laid on this upper side of the casting negative that the casting negative has a significant concave (away from the wooden spatula) deformation in the middle, which has arisen as a result of the deformation of the standard bending test bar B-V38 during casting with iron. Cores which are not dimensionally stable during casting cannot be used for manufacture of metal castings.

Figure 5:
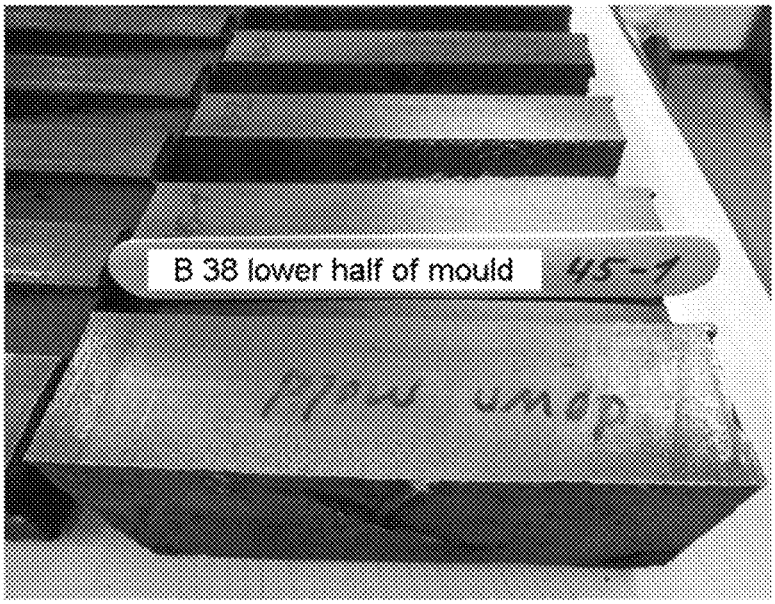

FIG. 5 shows, in cross section, the lower mould half of the iron casting. It is possible to see here the lower half of the hollow space (casting negative) formed by the standard bending test bar B-V38 (comparison) after removal thereof from the metal casting. It is possible to see with the aid of the straight wooden spatula laid on this underside of the casting negative that the casting negative has readily visible concave (away from the wooden spatula) deformations on each of the sides, which have arisen as a result of the deformation of the standard bending test bar B-V38 during casting with iron.

Figure 6:
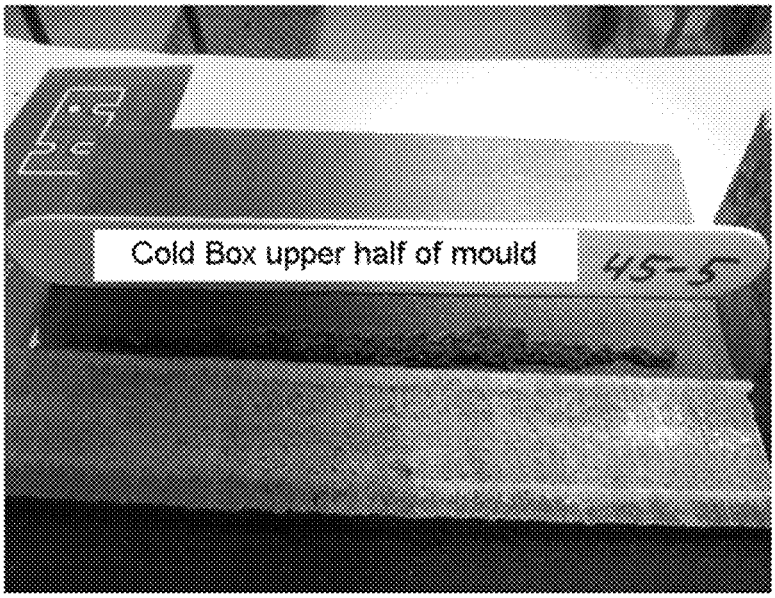

FIG. 6 shows, in cross section, the upper mould half of the iron casting. It is possible to see here the upper half of the hollow space (casting negative) formed by the standard bending test bar B-cold box (comparison) after the removal thereof from the metal casting. With the aid of the straight wooden spatula laid on this upper side of the casting negative, it is possible to see that the casting negative has no visible deformations and accordingly the standard bending test bar B-cold box (comparison) has not become visibly deformed during casting with iron. In addition, strong distortions in the region of the sand core can be seen. These have an adverse effect on the casting.

Figure 7:
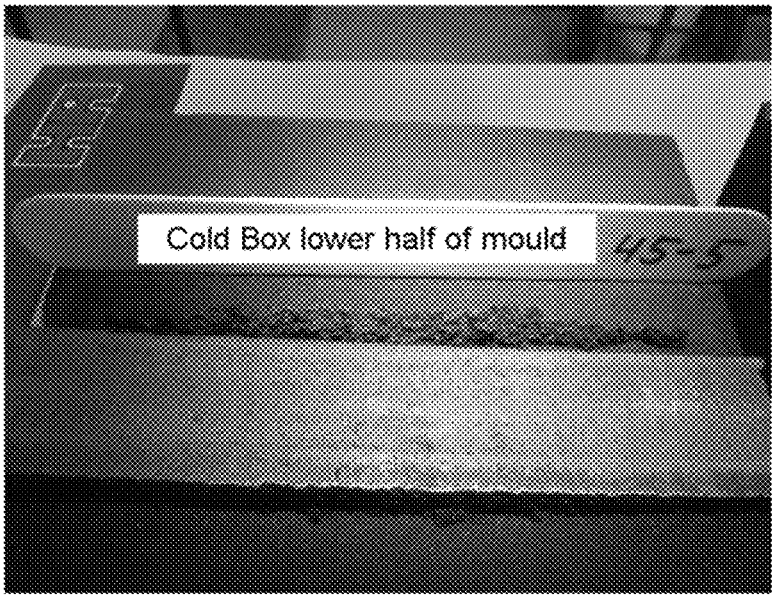

FIG. 7 shows, in cross section, the lower mould half of the iron casting. It is possible to see here the lower half of the hollow space (casting negative) formed by the standard bending test bar B-cold box (comparative) after the removal thereof from the metal casting. With the aid of the straight wooden spatula laid on this underside of the casting negative, it is possible to see that the casting negative has no visible deformations and accordingly the standard bending test bar B-cold box (comparison) has not become visibly deformed during casting with iron. In addition, severe distortions in the region of the sand core can be seen. These have an adverse effect on the casting.

Figure 8:
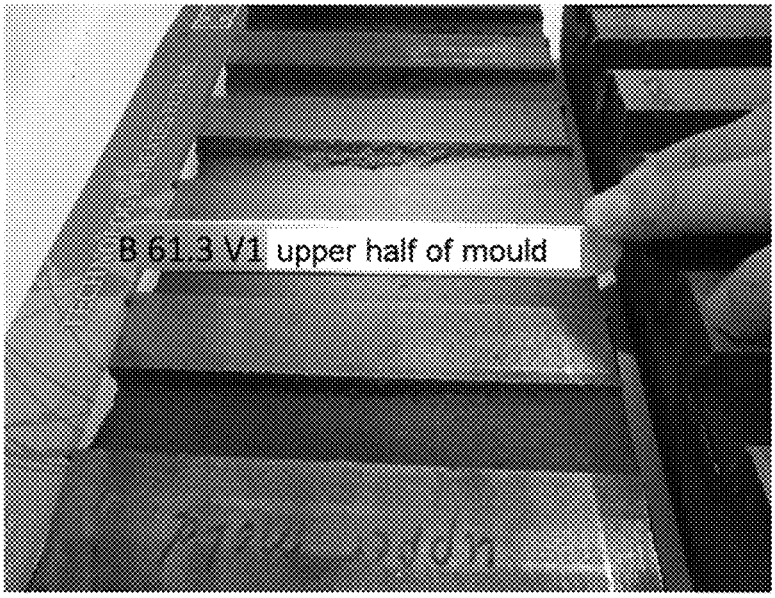

FIG. 8 shows, in cross section, the upper mould half of the iron casting. It is possible to see here the upper half of the hollow space (casting negative) formed by the standard bending test bar B-E61.3V1 (produced by the process of the invention) after removal thereof from the metal casting. With the aid of the straight wooden spatula laid on this upper side of the casting negative, it is possible to see that the casting negative has no visible deformations and accordingly the standard bending test bar B-E61.3V1 has not become visibly deformed during casting with iron. In comparison with FIG. 6 and FIG. 7, significantly lower distortion can also be seen.

Figure 9:
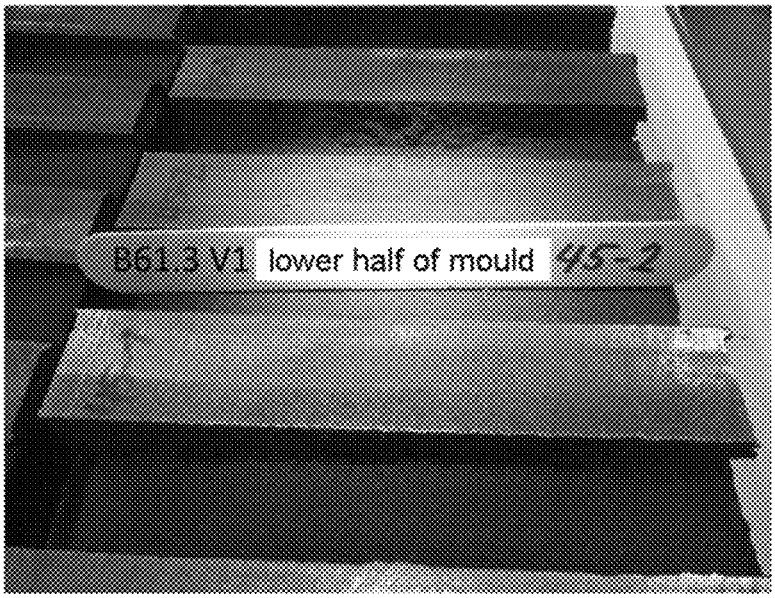

FIG. 9 shows, in cross section, the lower mould half of the iron casting. It is possible to see here the lower half of the hollow space (casting negative) formed by the standard bending test bar B-E61.3V1 (produced by the process of the invention) after removal thereof from the metal casting.

With the aid of the straight wooden spatula laid on this underside of the casting negative, it can be seen that the casting negative has no visible deformations and accordingly the standard bending test bar B-E61.3V1 (produced by the process of the invention) has not become visibly deformed during casting with iron.

Figure 10:
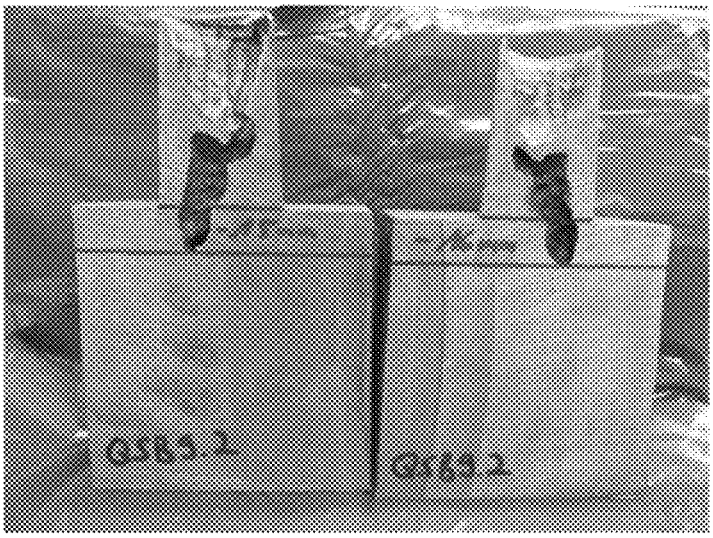

FIG. 10 shows, in cross section, an iron cube (modulus 1.68 cm) obtained in test casting using a cold box-bound feeder produced by a method which is not according to the invention, with the connection of the residual feeder composed of iron discernible at the top. Significant sink hole formation in the residual feeder, which extends into the metallic casting (iron cube), can be seen. For further explanations in respect of FIG. 10, see Example 13.

Figure 11:
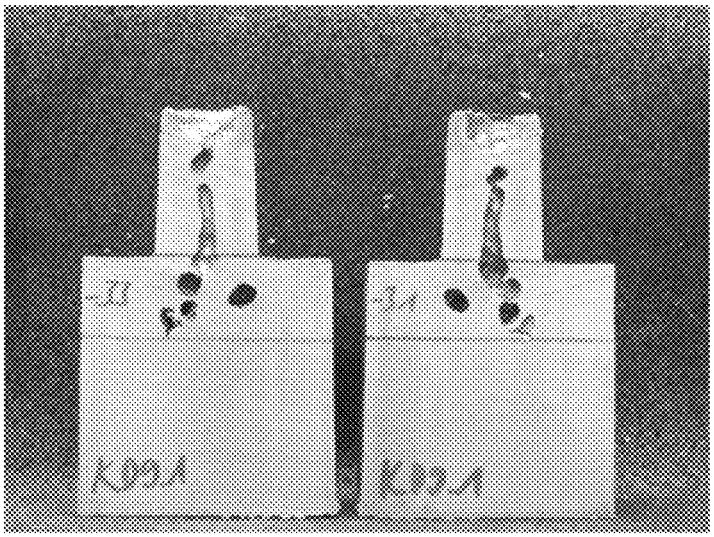

FIG. 11 shows, in cross section, an iron cube (modulus 1.68 cm) obtained in test casting using a water glass-bound feeder produced by a method which is not according to the invention, with connection of the residual feeder composed of iron discernible at the top. Significant sink hole formation in the residual feeder, which extends far into the metallic casting (iron cube), can be seen. For further explanations in respect of FIG. 11, see Example 13.

Figure 12:
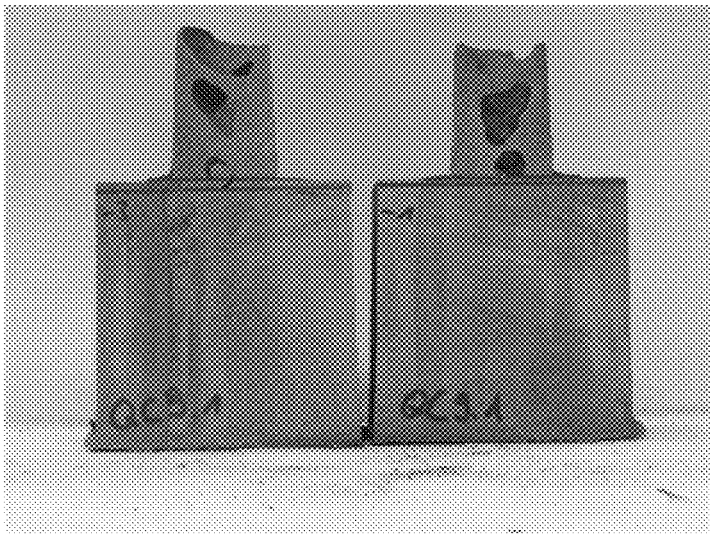

FIG. 12 shows, in cross section, an iron cube (modulus 1.68 cm) obtained in test casting using a feeder produced according to the invention ("feeder B-E68.4"), with connection of the residual feeder composed of iron discernible at the top. No sink hole formation in the metal casting (iron cube) can be seen; sink holes appear only in the residual feeder. For further explanations in respect of FIG. 12, see Example 13.

EXAMPLES

The following examples are intended to illustrate and explain the invention, without restricting its scope.

Unless indicated otherwise, the experiments were each carried out under laboratory conditions (atmospheric pressure, temperature 20° C., atmospheric humidity 50%).

Example 1

Production of Mould Material Mixtures

The constituents indicated in Table 1 below were used to produce mould material mixtures.

TABLE 1

Constituents of mould material mixtures

| Constituent | Mould material mixture | | | |
|---|---|---|---|---|
| | F-cold box | F-V38 | F-E61.3V1 | F-E68.4 |
| Silica sand BO42 [parts by weight] | 100 | 100 | 100 | 100 |
| Aqueous PVAL mixture [parts by weight] | 0 | 4.0 | 3.918 | 3.890 |
| Aqueous sulfuric acid mixture [parts by weight] | 0 | 0 | 0.082 | 0.110 |
| Cold box activator 6324 [parts by weight] | 1.2 | 0 | 0 | 0 |
| Cold box gas resin 7241 [parts by weight] | 1.2 | 0 | 0 | 0 |

Silica sand BO 42 (CAS No. 014808-60-7) from Bodensteiner Sandwerk GmbH & Co. KG was used as base mould material in each case.

A 25% strength by weight solution of polyvinyl alcohol (>93% of polyvinyl alcohol) having a degree of hydrolysis of about 88 mol % and a dynamic viscosity in the range from 3.5 to 4.5 mPa·s (measured as 4% strength by weight aqueous solution at 20° C. in accordance with DIN 53015), methanol content <3% by weight; CAS RN 25213-24-5, from Kuraray, was used as aqueous PVAL mixture.

A 36.5% strength by weight aqueous solution of sulfuric acid, CAS RN 7664-93-9, was used as aqueous sulfuric acid mixture.

A polyisocyanate customary for producing cold box binders (polyurethane resin based on benzyl ether) (activator 6324 from Hüttenes-Albertus Chemische Werke GmbH) was used as cold box activator 6324.

A phenolic resin customary for producing cold box binders (polyurethane resin based on benzyl ether) (gas resin 7241 from Hüttenes-Albertus Chemische Werke GmbH) was used as cold box gas resin 7241.

The mould material mixtures were produced as indicated below:

Mould material mixture F-cold box: the constituents indicated in Table 1 were mixed with one another in an electric mixer (Bosch Profi 67), forming a mould material mixture which could be shot or stamped to give a shaped part. The mould material mixture cold box is a mould material mixture for comparative purposes produced by a process which is not according to the invention.

Mould material mixture F-V38: the constituents indicated in Table 1 were mixed with one another in an electric mixer (Bosch Profi 67), forming a mould material mixture which could be shot or stamped to give a shaped part. The mould material mixture V38 is a mould material mixture for comparative purposes which has not been produced by the process of the invention or is not used in such a process.

Mould material mixture F-E61.3V: the constituents indicated in Table 1 were combined with one another in an electric mixer (Bosch Profi 67). For this purpose, the aqueous PVAL mixture and the aqueous sulfuric acid mixture were firstly combined with one another by means of mixing in a manner known per se to give a premix (or to give a binder system) and this premix was then combined with the initial charge of silica sand (base mould material) by mixing in the electric mixer. A mould material mixture which could be shot or stamped to give a shaped part was formed. The mould material mixture F-E61.3V is a mould material mixture produced by the process of the invention or used in such a process.

Mould material mixture F-E68.4: the constituents indicated in Table 1 were combined with one another in an electric mixer (Bosch Profi 67). For this purpose, the aqueous PVAL mixture and the aqueous sulfuric acid mixture were firstly combined with one another by mixing in a manner known per se to give a premix (or to give a binder system) and this premix was then combined with the initial charge of silica sand (base mould material) by mixing in the electric mixer. This formed a mould material mixture which could be shot or stamped to give a shaped part. The mould material mixture F-E61.3V is a mould material mixture produced by the process of the invention or used in such a process.

Example 2

Production of Standard Bending Test Bars

Standard bending test bars (representing a cured shaped part for use in the casting of metallic castings) for test purposes were produced in a manner known to a person skilled in the art from the mould material mixtures indicated in Example 1 by ramming (dimensions: 172×23×23 mm) in accordance with the method in the information sheet P73 (February 1996 issue) of the Verein Deutscher Gießereifachleute (hereinafter cited as "VDG information sheet P73"), No. 4.1.

To cure the bending test bars, the procedure indicated below was used in each case:

Bending test bar B-cold box: The mould material mixture cold box (see Example 1) was shaped as described above by ramming in a bending bar ramming box. The shaped mould material mixture was subsequently cured by means of the cold box process by passing gaseous (under the process conditions) N,N-dimethylpropylamine (about 1 ml liquid, 15 s) through it in accordance with the method in VDG information sheet P73, No. 4.3, method A.

Bending test bars B-V38, B-E61.3V1, B-E68.4: In all three cases, the mould material mixtures (for production, see Example 1) were shaped as described above by ramming in a bending bar ramming box. The shaped mould material mixtures were subsequently in each case cured by heating of the shaped mould material mixture in a drying oven for 25 minutes at 210° C. and removal of water from the shaped mould material mixture by ambient air deaeration of the drying oven to give the cured shaped part (standard bending test bar).

As an alternative method of curing to give the cured shaped part, bending test bars (dimensions: 187×22×22 mm) B-E68.4 were shaped using the mould material mixture F-E68.4 by shooting in a conventional core shooting machine as is also used for inorganic binders to give a shaped mould material mixture and cured by means of a tool having a temperature of 200° C. and blowing hot air (200° C., pressure: 6 bar) through it to give a cured shaped part. The shooting and passage of hot air were carried out under the length of the bending test bars.

Example 3

Determination of the Strength of Standard Bending Test Bars

The final strengths of the standard bending test bars produced in Example 2 above were in each case tested: the final strengths of the standard bending test bars B-cold box were for this purpose tested 24 hours after they had been produced. The final strengths of the standard bending test bars B-V38, B-E613V1 and B-68.4 were for this purpose in each case tested 30 minutes after they had been produced (drying). All standard bending test bars were stored under laboratory conditions. A triplicate determination of the final strengths, as described in the VDG information sheet P73, No. 5.2, using a Georg Fischer strength testing apparatus type PFG with low-pressure pressure gauge (with motor drive), was carried out in each case.

The bending strengths of the standard bending test bars reported below in Table 2 were determined in this way:

TABLE 2

Final strengths of standard bending test bars

| | Bending test bar: | | | |
|---|---|---|---|---|
| | B-cold box | B-V38 | B-E61.3V1 | B-E68.4 |
| Bending strengths (production by ramming) [N/cm$^2$] | 720 | 670 | 780 | 795 |

TABLE 2-continued

Final strengths of standard bending test bars

| | Bending test bar: | | | |
|---|---|---|---|---|
| | B-cold box | B-V38 | B-E61.3V1 | B-E68.4 |
| Bending strengths (production by shooting) [N/cm$^2$] | n.d. | n.d. | n.d. | 650 |

n.d.: values not determined.

It can be seen from the values reported in Table 2 that the shaped parts (standard bending test bars) B-E61.3V1 and B-E68.4 produced by the process of the invention have at least comparable and even better values for the final strengths than a corresponding shaped part produced by a customary cold box process. The shaped part B-V38 produced by a process which is not according to the invention (without catalytically active acid) displayed by comparison the lowest bending strength (final strength) under the experimental conditions.

Example 4

Production of Comparative Mould Material Mixtures

The constituents indicated in Table 3 below were used to produce further comparative mould material mixtures which were not produced by the process of the invention but instead by a process based on the process described in the document EP 1 721 689 A1.

TABLE 3

Constituents of comparative mould material mixtures

| | Comparative mould material mixture | | |
|---|---|---|---|
| Constituent | F-V01 | F-V02 | F-V03 |
| Silica sand BO42 [parts by weight] | 100 | 100 | 100 |
| Polyvinyl alcohol [parts by weight] | 0.2 | 0.2 | 1.2 |
| Starch (dextrin) [parts by weight] | 1.0 | 1.0 | 0 |
| Citric acid monohydrate [parts by weight] | 0.4 | 0.4 | 0.4 |
| Water [parts by weight] | 6.0 | 3.0 | 6.0 |

Polyvinyl alcohol (>93%, granular) having a degree of hydrolysis of about 88 mol % and a dynamic viscosity in the range from 3.5 to 4.5 mPa·s (measured as 4% strength by weight aqueous solution at 20° C. in accordance with DIN 53015), methanol content: <3% by weight; CAS RN 25213-24-5 was used as polyvinyl alcohol.

Comparative mould material mixture F-V01: the constituents indicated in Table 3 were mixed with one another in an electric mixer (Bosch Profi 67) and stirred until foamy. A fluid, castable mould material mixture which could, however, not be shot or stamped to give a shaped part was formed.

Comparative mould material mixture F-V02: the constituents indicated in Table 3 were mixed with one another in an electric mixer (Bosch Profi 67) and stirred until foamy. A mould material mixture which could be shot or stamped to give a shaped part was formed.

Comparative mould material mixture F-V03: the constituents indicated in Table 3 were mixed with one another in an electric mixer (Bosch Profi 67) and stirred until foamy. A fluid, castable mould material mixture which could, however, not be shot or stamped to give a shaped part was formed.

The three comparative mould material mixtures F-V01, F-V02 and F-V03 were subsequently, where possible, in each case shaped by ramming as described above (see Example 2) in a bending bar ramming box to give a shaped mould material mixture. Where possible, the shaped mould material mixture was then cured to give a cured shaped part:

Comparative mould material mixture F-V01: it was not possible to produce a dimensionally stable shaped mould material mixture under the standard conditions indicated (ramming), so that no cured shaped part could be produced.

Comparative mould material mixture F-V02: a mould material mixture shaped to give a bending test bar was obtained. This was cured as indicated below (see Example 5) to give a shaped part (bending test bar B-V02) and the result was compared with the result of a process according to the invention (see below, B-E61.3V1).

Comparative mould material mixture F-V03: it was not possible to produce a dimensionally stable shaped mould material mixture under the standard conditions indicated (ramming). The mould material mixture was then heated in the bending test bar mould for 1 minute at 250° C. in a drying oven and evaluated after cooling to room temperature: a cured shaped part had not been formed; the mould material mixture was still soft. A further mould material mixture produced in the same way was heated in the bending test bar mould in the convection drying oven for 5 minutes at 250° C. This resulted in formation of a hard outer shell on the shaped mould material mixture, but the interior of the mixture still remained soft.

It can be seen from the above observations that the comparative mould material mixtures F-V01 and F-V03 (corresponding to the process as indicated in the document EP 1 721 689 A1) could not be shot to give a shaped part or stamped to give a shaped part.

Furthermore, it can be seen from the above observations that it was not possible to obtain shaped parts cured so as to be water-resistant when using the comparative mould material mixtures F-V02 and F-V03 under the experimental conditions.

Example 5

Determination of the Water Resistances of Standard Bending Test Bars

Shaped mould material mixtures F-V02 (comparison, see Example 4) and F-E61.3V1 (produced according to the invention, see Example 2) were produced and cured under the conditions indicated in Table 4 below, in each case in a convection drying oven, to give the cured shaped part (standard bending test bar).

After curing was complete in each case, the bending strengths were determined in each case (as per Example 3) on the shaped parts which had been cooled for 30 minutes under laboratory conditions and cured and these bending strengths are likewise reported in Table 4.

The cured shaped parts were subsequently tested to determine their water resistances by the method indicated below:

Firstly, the intact standard bending test bars were dipped independently of one another into deionized water at 20° C. and atmospheric pressure for 30 minutes (stopwatch) in such a way that they were just completely covered with water. After the 30 minutes had expired, the standard bending test bars were promptly taken from the water and (if possible) tested to determine their consistency.

The remaining hardness of the standard bending test bars was subsequently tested, if possible, using a core hardness tester GM-578 (from Simpson Technologies GmbH, Switzerland). For this purpose, the corresponding standard bending test bar was in each case placed on a solid support and the penetration depth of the core hardness tester (according to handling instructions for the core hardness tester) was in each case measured once at a point on the outer surface (which had been in contact with the water). The measurement was carried out a total of three times at various points on the outer surface and the average of the three measurements has in each case been reported in Table 4 ("penetration depth on outer surface").

In order to test the water resistance in the interior of the shaped part (here: the standard bending test bar) as well, bending test bars produced in the same way as indicated above using the mould material mixtures F-V02 (comparison, see Example 4) and F-E61.3V1 (produced according to the invention, see Example 2) were then each sawn through in the middle of the height and just fully immersed in water for 30 minutes as indicated above, with the sawn-open interior cross-sectional area of the standard bending test bars being fully in contact with the water. After the bending test bar had been taken from the water, the remaining hardness of the bending test bar was measured again, this time in the middle of the interior cross-sectional areas, using the core hardness tester as indicated above. The measurement was again carried out a total of three times at different points on the interior cross-sectional areas and the average of the three measurements has in each case been reported in Table 4 ("penetration depth at interior cross-sectional area").

TABLE 4

Water resistance of standard bending test bars

| | Bending test bar | | | |
|---|---|---|---|---|
| | B-E61.3V1-(2) | | B-V02 | |
| | Curing conditions | | | |
| | 20 min 210° C. | 30 min 210° C. | 20 min 210° C. | 30 min 210° C. |
| Bending strengths (final strengths) [N/cm$^2$] | 870 | 750 | 240 | 330 |
| Penetration depth at outer surface [mm] | 6.4 | 0.7 | Not measurable | 2.4 |
| Penetration depth at interior cross-sectional area [mm] | 6.7 | 1.8 | Not measurable | 7.6 |

The comment "not measurable" in Table 4 means that it was not possible to measure any penetration depth on the corresponding bending test bar using the core hardness tester because the bar had disintegrated during storage in water for 30 minutes.

It can be seen from the measured values or comments in Table 4 that a cured shaped part produced by a process which is not according to the invention is not water-resistant (after 20 minutes at 210° C.) or not cured so as to be water-resistant all through (after 30 minutes at 210° C.) under the experimental conditions. In contrast, a cured shaped part produced by the process of the invention was, under the same experimental conditions, cured so as to be water-resistant after only 20 minutes (standard bending test bar does not disintegrate after being taken from the water) and was cured all through after 30 minutes (penetration depth of the core hardness tester on the interior cross-sectional area <4 mm).

Example 6

Determination of the Water Resistance of Standard Bending Test Bars

Standard bending test bars produced as in Example 2 above were placed on shelves in such a way that only their ends rested on the shelf (support area about 1/10 of the total area of the underside of the standard bending test bars, see below, Table 5). The shelves with the standard bending test bars thereon were introduced into a container filled with water so that the undersides of the standard bending test bars rested completely against the surface of the water and could absorb water by capillary forces. The water resistance of the standard test bars was then assessed visually over a period of 10 days.

The results of this experiment are indicated below in Table 5.

TABLE 5

Water resistance of standard bending test bars

| Time of experiment | Bending test bar (observation) | | |
|---|---|---|---|
| | B-cold box | B-V38 | B-E61.3V1 |
| 0 | intact | intact | intact |
| 3 s | intact | upper side displays moisture | intact |
| 37 s | intact | breakdown on support surface on one side | intact |
| 41 s | intact | breakdown on support surfaces both sides | intact |
| 351 s | intact | dissolution | upper side displays moisture |
| 10 d | intact | dissolved | upper side displays moisture |

It can be seen from the observations reported in Table 5 that the standard bending test bar bound by means of cold box binders was still completely water-resistant after 10 days. The bending test bar B-E61.3V1 produced by the process of the invention absorbs water after some time, but does not visibly lose water resistance. The comparative bending test bar B-V38 produced by a process which is not according to the invention (no acid-catalyzed etherifying crosslinking of a polymer comprising hydroxy groups), in contrast, completely lost its water resistance and began to dissolve after only a very short time.

Example 7

Behaviour of Standard Bending Test Bars During Casting of Iron

Standard bending test bars B-cold box (comparison), B-V38 (comparison) and B-E61.3V1 (produced by the process of the invention) produced as in Example 2 above were coated with a conventional alcohol wash (Koalid 4087 from Hüttenes-Albertus GmbH) in a manner known to those skilled in the art (conditions: running-out time 17.3 s; dipping time 7 s; drying at 110° C. for 40 minutes; wall thickness 325 μm in the wet state).

The standard bending test bars coated with the alcohol wash were then placed in a furan resin mould (dimensions 280×200×130 mm) which had been coated with an undiluted conventional, zircon-containing wash (Zirkofluid 1219 from Hüttenes-Albertus GmbH) and in this mould horizontally cast with iron (casting temperature about 1440° C.; about 3.09% by weight carbon content, about 1.89% by weight silicon content, in each case based on the total mass of the iron which was cast), so that the standard bending test bars were in each case completely enclosed by the iron casting and experienced maximum stress in terms of the applied load (by the iron as casting metal) during casting.

After the casting operation, the left-over residues of the standard bending test bars were removed from the iron casting by rotating the casting (so that the left-over residues of the standard bending test bars could fall out from the downwards-directed openings of the hollow spaces in the iron casting produced by the standard bending test bars) and the unpacking behaviour (core removal behaviour) of the standard bending test bars was evaluated visually. The following observations were made:

The left-over residues of the standard bending test bar B-cold box (comparison) were virtually impossible to remove from the iron casting mould in the manner indicated above; they remained virtually completely in the iron casting (cf. FIG. 1).

The left-over residues of the standard bending test bar B-V38 (comparison) could be removed readily and virtually completely from the iron casting in the manner indicated above (cf. FIG. 2).

The left-over residues of the standard bending test bar B-E61.3V1 (produced by the process of the invention) could be removed very readily and virtually completely from the iron casting in the manner indicated above (cf. FIG. 3).

The iron casting was subsequently sawn open in the middle (along the support surfaces of the standard bending test bars) so that the hollow spaces produced by the standard bending test bars were (after removal from the iron casting) divided into two halves right in the middle of the length in the iron casting. The cross sections of the hollow spaces produced by the standard bending test bars were as a result half in the upper half of the sawn-open metal casting (produced by the part of the standard bending test bar which was located at the top during the casting of iron, "upper mould half") and half in the lower half of the sawn-open metal casting (produced by the part of the standard bending test bar located at the bottom during the casting of iron, "lower mould half").

The upper and lower mould halves which had been exposed in this way were subsequently assessed visually to determine the casting resistance of the standard bending test bars used in the casting of iron and the removal thereof from the mould by buoyancy in liquid iron (recognizable by the deformations in the iron casting caused thereby). For this purpose, a straight wooden spatula was laid along the cross sections of the hollow spaces on the upper and lower mould halves produced by the standard bending test bars and the deviations from the casting negative of the upper side (in the upper mould half) and underside (in the lower mould half) of the said hollow spaces from the straight shape of the wooden spatula were in each case assessed.

The following observations were made here:

Standard bending test bar B-cold box (comparison): The casting negatives of the upper side (in the upper mould half) and underside (in the lower mould half) of the standard bending test bar (B-cold box) displayed no significant deviation from the straight line of the wooden spatula. The standard bending test bar B-cold box accordingly had barely deformed on casting with iron and displayed a high casting resistance (cf. FIG. 6 and FIG. 7).

Standard bending test bar B-V38 (comparison): The casting negative of the upper side (in the upper mould half) of the standard bending test bar B-V38 displayed a significant concave (away from the wooden spatula) deformation in the middle (max. height of the deviation: about 5 mm). The casting negative of the underside (in the lower mould half) of the standard bending test bar B-V38 displayed significant concave (away from the wooden spatula) deformations at the margins (max. height of the deviation: about 7 mm. The standard bending test bar B-V38 had accordingly become significantly deformed during casting with iron and displayed only a low casting resistance (cf. FIG. 4 and FIG. 5).

Standard bending test bar B-E61.3V1 (produced by the process of the invention): The casting negatives of the upper side (in the upper mould half) and underside (in the lower mould half) of the standard bending test bar B-E61.3V1 displayed no significant deviation from the straight line of the wooden spatula. The standard bending test bar B-E61.3V1 had accordingly barely deformed during casting with iron and displayed a high casting resistance (cf. FIG. 8 and FIG. 9).

It can be seen from the abovementioned observations that a shaped part produced by the process of the invention (here: standard bending test bar representing a core, feeder or mould) displayed very good removability of a core and also a high casting resistance during casting of metal and in the totality of its properties was significantly superior to the comparative shaped parts.

Example 8

Production of Standard Test Specimens (Standard Bending Test Bar and Standard Test Cylinder) from Insulating Feeder Composition as Mould Material Mixture The constituents indicated in Table 6 below were used to produce mould material mixtures for insulating feeders. The production of the mould material mixtures was carried out in a manner analogous to that indicated above in Example 1.

Standard bending test bars were subsequently shaped from the resulting mould material mixtures and cured in a manner analogous to that in Example 2 above to give standard bending test bars as cured shaped parts. Furthermore, standard test cylinders (height: 50 mm, diameter: 50 mm) were produced by ramming in accordance with the VDG standard P38 from the mould material mixtures obtained and were cured in a manner analogous to Example 2 above to give cured shaped parts (25 minutes at 210° C. in a convection drying oven for standard bending test bars and standard test cylinders using mould material mixture F-E68.4 (2)).

The 24 hour bending strengths (final strengths) of the standard bending test bars "B-cold box" (comparison) obtained were then determined in a manner analogous to that indicated above in Example 3. The bending strength of the standard bending test bars B-E68.4 obtained was determined after storage for 30 minutes under laboratory conditions (room temperature and room humidity) after completion of the drying procedure (final strengths). The results of all abovementioned measurements are reported below in Table 6 (in each case averages of 3 measurements).

The values of the gas permeabilities of the standard bending test bars and standard test cylinders and also their weight determined in each case are likewise reported in Table 6. The gas permeability is a test parameter which gives information about the densification of the microstructure. In the case of a feeder in particular, this is a characteristic value which can give information about satisfactory removal of casting gases during the casting operation.

TABLE 6

Constituents of mould material mixtures for insulating feeders

| Constituent | Mould material mixture | |
|---|---|---|
| | F-cold box (2) | F-E68.4 (2) |
| Expanded perlite [parts by weight] | 100 | 100 |
| Aqueous PVAL mixture [parts by weight] | 0 | 29.175 |
| Aqueous sulfuric acid mixture [parts by weight] | 0 | 0.825 |
| Cold box activator 6324 [parts by weight] | 9.0 | 0 |
| Cold box gas resin 7241 [parts by weight] | 9.0 | 0 |
| Mass of standard test cylinder [g] | 47 | 42 |
| Gas permeability of standard test cylinder | 45 | 50 |
| Bending strength [N/cm$^2$] of bending test bar (final strengths) | 350 | 360 |

The constituents "aqueous PVAL mixture", "aqueous sulfuric acid mixture", "cold box activator 6324" and "cold box gas resin 7241" indicated in Table 6 correspond to the constituents indicated in Example 1.

It can be seen from the results reported above in Table 6 that an insulating feeder composition produced by the process of the invention has comparable properties, in particular a comparable bending strength (i.e. final strength), as an insulating feeder composition which has been produced by a known cold box process.

Example 9

Casting of Shaped Parts with Aluminium or Iron

Insulating (closed at the bottom by a plate) feeders were produced in a manner known to a person skilled in the art (treatment with catalyst gas N,N-dimethylpropylamine) from the insulating feeder compositions produced in Example 8 above using mould material mixture "F-cold box (2)" by shooting in a core shooting machine.

Insulating feeders made from the insulating feeder compositions produced above in Example 8 using mould material mixture "F-E68.4 (2)" were shot in the same mould on the core shooting machine. Curing was carried out for 25 minutes at 210° C. in a drying oven (convection).

Insulating feeders produced in this way were set into a cold box-bound mould sand mould and cast with aluminium to test their behaviour under metal casting conditions. Further insulating feeders produced in this way were likewise set in loose mould sand and cast with iron instead of aluminium.

The following observations were made:

When the insulating feeder produced using the comparative mould material mixture F-cold box (2) (not according to the process of the invention) was cast with aluminium, strong fume formation was observed and this continued even after removal of the cast feeder from the mould sand.

When the insulating feeders produced using the mould material mixture F-E68.4 (2) (according to the process of the invention) were cast with aluminium, no fume formation was found. After the casting operation, the insulating feeder produced according to the invention displayed significantly better unpacking behaviour than the insulating feeder produced using the comparative mould material mixture F-cold box (2), i.e. the insulating feeder produced according to the invention could be separated significantly more readily from the aluminium. The aluminium castings formed displayed a significantly cleaner surface (i.e. without condensate deposits) than the aluminium castings which had been produced using the insulating feeder produced using the comparative mould material mixture F-cold box (2).

When the insulating feeders produced using the comparative mould material mixture F-cold box (2) (not according to the process of the invention) were cast with iron (at a temperature of 1410° C.), fume formation and emission of odours was found.

When the insulating feeder produced using the mould mixture F-E68.4 (2) (according to the process of the invention) was cast with iron (at a temperature of 1410° C.), no fume formation or emission of odours was found, even after the cast feeder had been taken from the mould sand. After the casting operation, the insulating feeder produced according to the invention displayed significantly better unpacking behaviour than the insulating feeder produced using the comparative mould material mixture F-cold box (2): when the casting specimen was mechanically pulled, the feeder cast with iron disintegrated virtually completely. In addition, the iron casting formed displayed a significantly cleaner surface, with more readily mechanically removable sand and a smoother surface structure than the iron casting which had been produced using the insulating feeder produced using the comparative mould material mixture F-cold box (2).

Example 10

Production of Standard Test Specimens from Exothermic Feeder Composition as Mould Material Mixture The constituents indicated in Table 7 below were used to produce mould material mixtures for exothermic feeders. The production of the mould material mixtures was carried out in a manner analogous to that indicated above in Example 1.

Test specimens (standard bending test bars and standard test cylinders) were subsequently shaped from the mould material mixtures obtained and were cured in a manner analogous to Example 2 above to give cured standard bending test bars and standard test cylinders as (representative or model) cured shaped parts. The curing of the test specimens made using the mould material mixture F-E68.4 (3) was carried out by heating and removal of water for 25 minutes at 210° C. in a drying oven (convection).

The bending strengths of the standard bending test bars obtained were then determined in a manner analogous to that indicated above in Example 3. The results of these measurements are reported below in Table 7 (averages of 3 measurements).

The values of the gas permeabilities of the standard test cylinders and also their weight which were determined in each case are likewise reported in Table 7.

TABLE 7

Constituents of mould material mixtures for exothermic feeders

| Constituent | Mould material mixture | |
|---|---|---|
| | F-cold box (3) | F-E68.4 (3) |
| Silica sand BO42 [parts by weight] | 32.00 | 32.00 |
| Spheres composed of fly ash [parts by weight] | 25.00 | 25.00 |
| Aluminium [parts by weight] | 23.00 | 23.00 |
| Iron oxide [parts by weight] | 5.00 | 5.00 |
| Oxidant ($KNO_3$) [parts by weight] | 12.00 | 12.00 |
| Igniter (cordierite) [parts by weight] | 3.00 | 3.00 |
| Aqueous PVAL mixture [parts by weight] | 0 | 14.588 |
| Aqueous sulfuric acid mixture [parts by weight] | 0 | 0.413 |
| Cold box activator 6324 [parts by weight] | 4.50 | 0 |
| Cold box gas resin 7241 [parts by weight] | 4.50 | 0 |
| Mass of standard test cylinder [g] | 98 | 92 |
| Gas permeability of standard test cylinder | 90 | 135 |
| Bending strength of standard bending test bar (final strengths) [N/cm$^2$] | 450 | 460 |

The constituents "aqueous PVAL mixture", "aqueous sulfuric acid mixture", "cold box activator 6324" and "cold box gas resin 7241" indicated in Table 7 correspond to the constituents indicated in Example 1.

It can be seen from the results reported above in Table 7 that an exothermic feeder composition produced by the process of the invention has comparable properties, in particular a comparable bending strength (final strength), to an exothermic feeder composition produced by a known cold box process.

Example 11

Burning of Exothermic Feeders

Standard test cylinders were produced by ramming in accordance with the VDG standard P38 from the exothermic feeder compositions produced above in Example 10. In the case of the exothermic feeder composition using mould material mixture "F-cold box (3)", curing was carried out in a manner known to a person skilled in the art by treatment with the catalyst gas N,N-dimethylpropylamine. In the case of the exothermic feeder composition "F-E68.4 (3)", curing to give the cured shaped part (exothermic feeder) was carried out by heating and removal of water for 25 minutes at 210° C. in a drying oven (convection).

Exothermic feeders produced in this way were burnt in a manner known to a person skilled in the art in accordance with the VDG standard P81 (here without temperature-time measurement). The parameters reported below in Table 8 were determined here.

TABLE 8

| Parameters in the burning of exothermic feeders | | |
|---|---|---|
| | Exothermic feeder from mould material mixture | |
| Parameter | F-cold box (3) | F-E68.4 (3) |
| Ignition time [s] | 8 | 8 |
| Burning time [s] | 179 | 178 |

In addition, the following observations were made:

Significant fume formation was observed in the burning of the exothermic feeder which had been produced using the comparative mould material mixture F-cold box (3) (not according to the process of the invention) (conventional cold box binder).

Virtually no fume formation was found in the burning of the exothermic feeder produced using the mould material mixture F-E68.4 (3) according to the process of the invention.

It can be seen from the results reported above that cured shaped parts (here: exothermic feeders) produced by the process of the invention displayed significantly reduced emissions under practical conditions compared to shaped parts produced by the conventional cold box process.

Example 12

Production of Aqueous Binder Systems

The constituents indicated in Table 9 below were used to produce aqueous binder systems.

TABLE 9

| Constituents of aqueous binder systems | | | |
|---|---|---|---|
| | Aqueous binder system | | |
| Constituent | WB-V38 | WB-E61.3V1 | WB-E68.4 |
| Aqueous PVAL mixture [parts by weight] | 100 | 97.94 | 97.26 |
| Aqueous sulfuric acid mixture [parts by weight] | 0 | 2.06 | 2.74 |

The constituents "aqueous PVAL mixture" and "aqueous sulfuric acid mixture" indicated in Table 9 correspond to the constituents indicated in Example 1.

The aqueous binder systems WB-E61.3V1 and WB-E68.4 are aqueous binder systems to be used according to the invention. The aqueous binder system WB-V38 is an aqueous binder system which is for comparison and is not to be used according to the invention.

Example 13

Test Casting of Iron Cubes

The mould material mixtures indicated below in Table 10 were each shaped in a core shooting machine to give feeders.

In the case of the feeder mixture "F-cold box (4)", curing was carried out in a manner known to a person skilled in the art by treatment with the catalyst gas N,N-dimethylpropylamine. In the case of the "F-water glass" feeder mixture, curing was carried out for 25 minutes at 210° C. in a drying oven (convection). In the case of the feeder composition "F-E68.4 (4)", curing to give the cured shaped part was carried out by heating and removal of water for 25 minutes at 210° C. in a drying oven (convection). This resulted in the feeders "feeder cold box" and "feeder water glass" produced by a method which was not according to the invention and in the feeders "feeder B-E68.4" produced according to the invention.

TABLE 10

| Compositions of mould material mixtures for feeders | | | |
|---|---|---|---|
| | Mould material mixture | | |
| Constituent | F-cold box (4) | F-water glass | F-E68.4 (4) |
| Silica sand [parts by weight] | 100 | 100 | 100 |
| Aqueous PVAL mixture [parts by weight] | 0 | 0 | 3.890 |
| Aqueous sulfuric acid mixture [parts by weight] | 0 | 0 | 0.110 |
| Cold box activator 6324 [parts by weight] | 1.2 | 0 | 0 |
| Cold box gas resin 7241 [parts by weight] | 1.2 | 0 | 0 |
| Sodium water glass binder 48/50 [parts by weight] | 0 | 1.5 | 0 |

The constituents indicated in Table 10 in each case correspond to the constituents indicated in Example 1 and the meanings thereof.

As sodium water glass binder 48/50, use was made of an aqueous solution of a standard water glass binder having a water glass content (sodium silicate content) in the range from 25% by weight to 35% by weight and a pH at 20° C. in the range from 11 to 12 (CAS RN 1344-09-8).

The abovementioned feeders were in each case checked for industrial usability, in particular the quality of their feeder action, by use in the test casting of an iron cube (model of a metallic casting). For this purpose, the feeders of the same size (i.e. in each case the same modulus) were each used in the test casting of cubes having a modulus of (i.e. having a ratio of volume to surface area of) 1.68 cm by means of iron (GGG40) at a casting temperature of 1400° C. A person skilled in the field of foundry technology will frequently utilize cubes which have a significantly greater modulus than the feeders for the quality evaluation in order to be able to obtain the best possible information on the solidification from the experiment. The quality of the feeding action is assessed from the depth of the sink hole extending into the cube: sink holes extending deeper into the cube (the metal casting) indicate a poorer feeding action.

The test cubes produced as indicated above were sawn in the middle (halved) after casting and cooling to room temperature in order to expose their cross section and to assess the quality of casting, and also the quality of the feeder action of the feeders used in each case. The cross sections obtained by sawing-open of the test cubes with the visible feeder residue composed of iron attached at the top are depicted in FIG. 10 (casting of iron using the feeder "feeder cold box" which had been produced by a method which is not according to the invention), in FIG. 11 (casting of iron using the feeder "feeder water glass" produced by a method which is not according to the invention) and in FIG. 12 (casting of iron using the feeder "feeder B-E68.4" produced according to the invention).

It can be seen in FIG. 10 that when using a cold box-bound feeder under the experimental conditions, significant sink hole formation which extends into the metallic casting takes place. The annotation "−15 mm" (left-hand half of the cross section) or "−16 mm" (right-hand half of the cross section) indicates in each case the distance between the line visible at the top in the image (at the feeder residue connection, i.e. the boundary between metallic feeder residue and the metallic casting) and the line visible at the bottom in the image (marking for the deepest point of the metallic casting or of the sink hole in the metallic casting).

It can be seen in FIG. 11 that when using a water glass-bound feeder produced by a method which is not according to the invention under the experimental conditions, pronounced sink hole formation which extends far into the metallic casting takes place. The annotation "−33" (mm) (left-hand half of the cross section) or "−31" (mm) (right-hand half of the cross section) in each case indicates the distance between the line visible at the top in the image (at the feeder residue connection, i.e. the boundary between metallic feeder residue and the metallic casting) and the line visible at the bottom in the image (marking for the deepest point of the metallic casting or of the sink hole in the metallic casting). The poor quality of the feeder action of the water glass-bound feeder under the experimental conditions is presumably attributable to the comparatively high heat energy uptake of the water glass binder (known as its disadvantageous "quenching behaviour") and the resulting comparatively early solidification of the cast metal.

It can be seen in FIG. 12 that when using the feeder "feeder B-E68.4" produced according to the invention, the sink hole formed extends significantly less deeply into the iron casting (test cube) than when using known water glass-bound or cold box-bound feeders. The annotation "−3" (mm) (left-hand half of the cross section) or "−1" (mm) (right-hand half of the cross section) in each case indicates the distance between the line visible at the top in the image (at the feeder residue connection, i.e. the boundary between metallic feeder residue and the metallic casting) and the line visible at the bottom in the image.

From the FIGS. 10 to 12 indicated above, it is therefore possible to see that a feeder produced according to the invention has a significantly improved feeding capability than the known cold box-bound or water glass-bound feeders employed for comparison.

The invention claimed is:

1. A process (i) for producing a metallic casting or (ii) for producing a cured shaped part selected from the group consisting of casting mould, core and feeder for use in the casting of metallic castings, comprising:

provision or production of a base mould material, provision or production of (a) an aqueous mixture comprising one or more aliphatic polymers in each case comprising structural units containing hydroxy groups and having the formula (I)

$$—CH_2—CH(OH)— \quad (I),$$

provision or production of (b) an aqueous mixture comprising one or more acids and/or one or more heat-labile acid precursors as catalyst for etherification of the hydroxy groups of the aliphatic polymer or polymers, combining of the base mould material with (a) the aqueous mixture comprising one or more aliphatic polymers and (b) with the aqueous mixture comprising one or more acids and/or one or more heat-labile acid precursors to give a mould material mixture, wherein the mould material mixture is free of aromatics and free of phenolic resins, shaping of the mould material mixture and to effect curing of the shaped mould material mixture to give the cured shaped part, heating of the shaped mould material mixture so that heat-labile acid precursors present in the mould material mixture decompose with liberation of acid and/or hydroxy groups of the aliphatic polymer or polymers crosslink with one another in the presence of the acid or acids with etherification of the hydroxy groups, and removal of water from the heated shaped mould material mixture, wherein the one or more acids and/or the one or more heat-labile acid precursors are selected from the group consisting of:

inorganic prone acids which have a pKa of ≤7, monoprotic organic protic acids, which have a pKa of ≤7, Lewis acids, selected from the group consisting of boron trifluoride and the chlorides and bromides of boron, aluminium, phosphorus, antimony, arsenic, iron, zinc, and tin, and salts which can be thermally decomposed to acids, selected from the group consisting of:

ammonium salts of mineral acids, and sulphuric acid salts of alkanolamines.

2. The process according to claim 1, wherein the total moisture content of the mould material mixture is set before or during shaping of the mould material mixture so that a mould material mixture which is able to be shot to give a shaped part, and/or is able to be stamped to give a shaped part, results;

and/or the step of curing of the shaped mould material mixture by heating of the shaped mould material mixture and removal of water from the heated shaped mould material mixture is carried out at least until a water-resistant cured shaped part results, and/or the shaping of the mould material mixture is carried out by shooting, or by introduction into a moulding box, and/or the mould material mixture comprises a sand, and has a proportion of solids of more than 95% by weight, based on the total mass of the mould material mixture, and/or foam formation or bubble formation in the mould material mixture is minimised or avoided when carrying out the process in one or both steps selected from combining of the base mould material with (a) the aqueous mixture comprising one or more aliphatic polymers and (b) with the aqueous mixture comprising one or more acids and/or one or more heat-labile acid precursors to give a mould material mixture and shaping of the mould material mixture.

3. The process according to claim 1, wherein the heating of the shaped mould material mixture is carried out to a temperature in the range from 100° C. to 300° C., and/or the removal of water from the heated shaped mould material mixture is carried out by means of one or more measures selected from the group consisting of passage of a heated gas, evacuation and drying in a drying apparatus.

4. The process according to claim 1, wherein the aliphatic polymers used
can be produced by at least partial hydrolysis of polyvinyl acetate,
and/or
are dissolved in the aqueous mixture in which they are present in an amount of at least 90% by weight, based on the total mass of aliphatic polymers used.

5. The process according to claim 1, wherein the one or more aliphatic polymers comprise one or more polyvinyl alcohols,
where the totality of the polyvinyl alcohols used
has a degree of hydrolysis of >50 mol %,
and/or
has a dynamic viscosity in the range from 0.1 to 30 mPa·s determined on a 4% strength (w/w) aqueous solution of the totality of the polyvinyl alcohols used at 20° C.

6. The process according to claim 1,
wherein the base mould material comprises:
one or more particulate refractory solids selected from the group consisting of
oxides, silicates and carbides, in each case comprising one or more elements from the group consisting of Mg, Al, Si, Ca, Ti, Fe and Zr;
mixed oxides, mixed carbides and mixed nitrides, in each case comprising one or more elements from the group consisting of Mg, Al, Si, Ca, Ti, Fe and Zr;
and
graphite
and/or
one or more particulate lightweight fillers selected from the preferred group consisting of
core-shell particles, having a glass core and a refractory shell;
spheres composed of fly ash;
composite particles;
perlite;
rice hull ash;
expanded glass,
hollow glass spheres,
and
hollow ceramic spheres.

7. The process according to claim 1, wherein
the ratio
of the total mass of aliphatic polymers used
to
the total mass of base mould material used is in the range from 0.2:100 to 13:100,
and/or
the ratio of the sum
of the total mass of the aqueous mixture comprising one or more aliphatic polymers (a) which is used
and
the total mass of the aqueous mixture comprising ono or more acids and/or one or more heat-labile acid precursors (b) which is used
to
the total mass of base mould material used is in the range from 1:100 to 50:100;
and/or
the ratio
of the total mass of acids and/or heat-labile acid precursors used to
the total mass of aliphatic polymers used is in the range from 1:5 to 1:50.

8. The process according to claim 1 wherein the one or more acids and/or the one or more heat-labile acid precursors, are selected:
from the group consisting of inorganic protic acids which have a pKa of ≤3 and/or
from the group consisting of phosphoric acid and sulfuric acid.

9. The process (i) according to claim 1 comprising:
contacting of the cured shaped part with a casting metal to produce a metallic casting, with the casting metal solidifying in contact with the cured shaped part.

10. The process (i) according to claim 1, wherein
the casting metal is selected from the group consisting of aluminium, magnesium, tin, zinc and alloys thereof
and/or
the temperature of the casting metal during casting is not higher than 900° C.

11. The process according to claim 1, wherein the one or more aliphatic polymers comprise one or more polyvinyl alcohols, where the totality of the polyvinyl alcohols used
has a degree of hydrolysis of in the range from 70 mol % to 100 mol %, and/or
has a dynamic viscosity in the range from 1.0 to 15 mPa·s determined on a 4% strength (w/w) aqueous solution of the totality of the polyvinyl alcohols used at 20° C.

12. The process according to claim 1, wherein the base mould material comprises:
one or more particulate lightweight tillers selected from the preferred group consisting of
core-shell particles, having a glass core and a refractory shell and a bulk density in the range from 470 to 500 g/l;
spheres composed of fly ash;
composite particles;
closed-pored microspheres composed of expanded perlite;
rice hull ash;
expanded glass,
hollow glass spheres, and
hollow α-alumina spheres.

13. The process according to claim 1, wherein
the ratio
of the total mass of aliphatic polymers used to
the total mass of base mould material used is in the range from 0.3:100 to 10:100 and/or
the ratio of the sum
of the total mass of the aqueous mixture comprising one or more aliphatic polymers (a) which is used and
the total mass of the aqueous mixture comprising one or more acids and/or one or more heat-labile acid precursors (b) which is used to
the total mass of base mould material used is in the range from 1.5:100 to 40:100;
and/or
the ratio
of the total mass of acids and/or heat-labile acid precursors used to
the total mass of aliphatic polymers used is in the range from 1:10 to 1:50.

14. The process according to claim 1, wherein the one or more acids and/or the one or more heat-labile acid precursors are selected from the group consisting of:
inorganic protic acids which have a pKa of ≤5,
monoprotic organic protic acids which have a pKa of ≤7,
water-soluble Lewis acids.

15. The process according to claim 1, wherein
the ratio
of the total mass of aliphatic polymers used to
the total mass of base mould material used is in the range from 0.5:100 to 9:100,
and/or
the ratio of the sum
of the total mass of the aqueous mixture comprising one or more aliphatic polymers (a) which is used
and
the total mass of the aqueous mixture comprising one or lore acids and/or one or more heat-labile acid precursors (b) which is used to
the total mass of base mould material used is in the range from 2:100 to 35:100;
and/or
the ratio
of the total mass of acids and/or heat-labile acid precursors used to
the total mass of aliphatic polymers used is in the range from 1:20 to 1:40.

* * * * *